US009565721B2

(12) United States Patent
Okada et al.

(10) Patent No.: US 9,565,721 B2
(45) Date of Patent: Feb. 7, 2017

(54) INDUCTION HEATING APPLIANCE FOR COOKING

(75) Inventors: Kazuichi Okada, Hyogo (JP); Masahiro Yokono, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 960 days.

(21) Appl. No.: 12/519,586

(22) PCT Filed: Dec. 18, 2007

(86) PCT No.: PCT/JP2007/074297

§ 371 (c)(1),
(2), (4) Date: Jun. 17, 2009

(87) PCT Pub. No.: WO2008/075673

PCT Pub. Date: Jun. 26, 2008

(65) Prior Publication Data

US 2009/0314771 A1 Dec. 24, 2009

(30) Foreign Application Priority Data

Dec. 18, 2006 (JP) ..... 2006-339593

(51) Int. Cl.
*H05B 6/06* (2006.01)

(52) U.S. Cl.
CPC ..... *H05B 6/062* (2013.01); *H05B 2213/07* (2013.01)

(58) Field of Classification Search
CPC .... H05B 6/062; H05B 2213/06; H05B 6/1263
(Continued)

(56) References Cited

U.S. PATENT DOCUMENTS 3,719,789 A * 3/1973 Harnden, Jr. ..... 219/627
6,007,242 A 12/1999 Uehashi et al.
(Continued)

FOREIGN PATENT DOCUMENTS

JP 2003-133044 5/2003
JP 2005-038660 2/2005
(Continued)

OTHER PUBLICATIONS

Machine translation: JP 2006294286 Aug. 2012.*
(Continued)

*Primary Examiner* — Tu B Hoang
*Assistant Examiner* — Thomas Ward
(74) *Attorney, Agent, or Firm* — Wenderoth, Lind & Ponack, L.L.P.

(57) ABSTRACT

An infrared sensor for detecting infrared rays of light and a light emitting element are disposed below a light transmittable top plate, which has a hearing area for heating an article to be heated placed thereon, in juxtaposed fashion relative to each other, so that infrared rays of light radiated from the article to be heated may be guided towards the infrared sensor. A light guide portion is provided for guiding rays of flight, emitted from the light emitting element, towards a heating area of the top plate, and the rays of light emitted from the light emitting element and guided by the light guide portion are projected onto the top plate through an upper opening of the light guide portion so that such rays of light can be noticed with eyes within the heating area.

12 Claims, 14 Drawing Sheets

(58) Field of Classification Search
USPC ..... 219/620–627, 661–667
See application file for complete search history.

(56) References Cited

U.S. PATENT DOCUMENTS

| | | | | |
|---|---|---|---|---|
| 2003/0206572 | A1 | 11/2003 | Dorwarth et al. | |
| 2006/0181416 | A1* | 8/2006 | Chen | 340/545.2 |
| 2007/0278216 | A1 | 12/2007 | Tominaga et al. | |

FOREIGN PATENT DOCUMENTS

| | | | |
|---|---|---|---|
| JP | 2005-317305 | | 11/2005 |
| JP | 2006-294286 | | 10/2006 |
| JP | 2006294286 | A * | 10/2006 |
| JP | 2006-331910 | | 12/2006 |
| JP | 2007123075 | A * | 5/2007 |
| JP | 2008-027730 | | 2/2008 |
| RU | 2 145 040 | | 1/2000 |
| RU | 2 204 157 | | 5/2003 |
| WO | 98/30941 | | 7/1998 |
| WO | 2008/010435 | | 1/2008 |

OTHER PUBLICATIONS

Machine translation: JP 2007123075, Aug. 2012.*

Russian Office Action—"Decision on Grant", issued Nov. 9, 2011 (with English translation) in a Russian application that is a foreign counterpart to the present application.

International Search Report issued Mar. 25, 2008 in the International (PCT) Application of which the present application is the U.S. National Stage.

English translation of International Preliminary Report on Patentability (PCT Chapter II) issued Sep. 3, 2009 in International (PCT) Application No. PCT/JP2007/074297.

Supplemental European Search Report, issued Mar. 2, 2012 in EP Application 07 85 0785.2, which is a counterpart to the present application.

European Office Action dated Apr. 23, 2014 issued in corresponding European Application No. 07 850 785.2.

Canadian Office Action dated May 6, 2014 issued in corresponding Canadian Patent Application No. 2672788.

Canadian Office Action dated May 11, 2015 issued in corresponding Canadian Patent Application No. 2672788.

* cited by examiner

INDUCTION HEATING APPLIANCE FOR COOKING

TECHNICAL FIELD

The present invention relates to an induction heating appliance for induction heating a material to be heated, which utilizes an infrared sensor for controlling the temperature of the material to be heated.

BACKGROUND ART

The prior art induction heating appliance for cooking is so designed that an infrared sensor is arranged at a center of a heating coil and an inverter circuit is controlled by a controlling means in dependence on an output from the infrared sensor to thereby control the output of the heating coil. (See, for example, Patent Document 1 listed below.)

Patent Document Japanese Laid-open Patent Publication No. 2005-38660

DISCLOSURE OF THE INVENTION

Problems to be Solved by the Invention

It has, however, been found that in the induction heating appliance for cooking of the structure referred to above, when an article to be heated such as, for example, a pot, which is empty (nothing to be cooked is contained in the article to be heated), temperature abruptly increases at a portion of the article to be heated above that portion of the heating coil winding intermediate between the outermost periphery thereof and the innermost periphery thereof, where the density of magnetic flux developed is highest to emit the maximum heat during the heating, and, therefore, it often occurs that as a result of delay in response to control the heating output with respect to a high temperature region of the article to be heated, when a thin-walled stainless steel pot of a kind having an inferior thermal conductivity and a low heat capacity is used as the article to be heated, the bottom of the pan tends to be red heated enough to deform by the effect of the elevated temperature or a material to be cooked containing a slight quantity of oil or the like will be heated to a high temperature.

If the infrared sensor is arranged so as to detect the temperature of the article to be heated which is placed at an intermediate portion of the heating coil, not the center of the heating coil, or in the vicinity of the inner periphery of the winding of the heating coil, the above discussed problems would be resolved. However, where the infrared sensor is to be provided below the top plate, an incident window (hereinafter referred to as an infrared incident region), through which infrared rays of light from the article to be heated that is placed on the top plate, can be incident upon the infrared sensor, the infrared sensor will be disposed at a location offset from the center of the heating coil. In such case, the article to be heated will not be necessarily placed above the infrared incident region and, if the user erroneously places the article to be heated not to obstruct the infrared incident region, the infrared sensor will fail to detect the temperature of the article to be heated properly. In particular, in the case where the ambiance around the induction heating appliance for cooking is dark, a problem is often recognized that the infrared incident region is hardly noticed with eyes.

The present invention has been devised with due consideration paid to those problems inherent in the prior art and has for its object to provide a convenient induction heating appliance for cooking, in which the incident region, where infrared rays of light emitted from the article to be heated can be incident on the infrared sensor, can be easily noticed with eyes so that the control of the temperature of the article to be heated in dependence on the infrared sensor can be accomplished assuredly.

Means to Solve the Problems

In accomplishing the above object, the induction heating appliance for cooking according to the present invention includes a light transmittable top plate provided atop a body and having a heating area for heating an article to be heated with the latter placed thereon; a heating coil disposed below the top plate in face-to-face relation with the heating area for generating magnetic fields necessary to induction heat an article to be heated; an infrared sensor disposed below the top plate for detecting infrared rays of light; a light emitting element disposed below the top plate; a light guide portion for guiding the infrared rays of light, emitted from the article to be heated, towards the infrared sensor, the light guide portion being defined by only one light guide tube, the light guide tube having only one longitudinal axis, the light guide portion being configured such that the infrared rays of light from the article to be heated are guided to the infrared sensor along the only one longitudinal axis of the light guide tube, and such that the visible light from the light emitting element is guided to the top plate along the only one longitudinal axis of the light guide tube; and a control means for controlling an output of the heating coil based on an output signal from the infrared sensor, characterized in that an infrared incident region for guiding the infrared rays of light, emitted from the article to be heated, towards the light guide portion is provided at a location inwardly of an outer periphery of the heating coil of the top plate and offset from a center of the heating coil, so that rays of light emanating from the light emitting element are emitted within the infrared incident region to allow the rays of light to be noticed within the heating area when viewed from above the body.

In pace of the arrangement, in which the light emitted from the light emitting element is caused to illuminate within the infrared incident region and such light is noticeable within the heating area when viewed from above the body, the light emitted from the light emitting element may be caused to illuminate in proximity to the infrared incident region and such light is noticeable within the heating area when viewed from above the body.

The infrared incident region may be provided only at one location inwardly of the outer periphery of the heating coil.

The induction heating appliance according to a different embodiment of the present invention includes a light transmittable top plate provided atop a body and having a heating area for heating an article to be heated with the latter placed thereon; a heating coil disposed below the top plate in face-to-face relation with the heating area for generating magnetic fields necessary to induction heat the article to be heated; an infrared sensor disposed below the top plate for detecting infrared rays of light; a light emitting element disposed below the top plate; a light guide portion for guiding the infrared rays of light, emitted from the article to be heated, towards the infrared sensor; and a control means for controlling an output of the heating coil based on an output signal from the infrared sensor, characterized in that the top plate is provided with an infrared incident region positioned at a location inwardly of an outer periphery of the heating coil and offset from the center of the heating coil to guide the infrared rays of light, emitted from the article to be heated, towards the light guide portion, so that rays of light emanating from the light emitting element are emitted within the infrared incident region to allow the rays of light to be noticed within the heating area when viewed from above the body, and in that the light guide portion guides the light, emitted from the light emitting element, towards the infrared incident region, and the infrared incident region is partly or entirely noticeable when the light emitted from the light emitting element and guide within the light guide portion is projected towards the top plate through an opening of the light guide portion.

When viewed from above the body, the infrared incident region may have a center arranged on a straight line passing across a center of the heating coil and a center of a light emitting portion, which is a region where the light emitted from the light emitting element can be noticed, or its vicinity and between the center of the heating coil and the center of the light emitting portion.

A light guide element, upon which the light from the light emitting element is incident and which has a light emitting surface illuminated in an annular shape may be further provided, in which case the light from the light emitting element is guided from the light emitting surface of the light emitting element towards the light guide portion.

The infrared rays of light radiated from the article to be heated may be guided towards the infrared sensor through the opening after having passed through a through-hole formed inside the light emitting surface.

The infrared sensor and the light emitting element altogether may form a sensor unit, in which case the sensor unit includes a printed circuit board for fixing and electrically connecting the infrared sensor and the light emitting element, a housing made of an electroconductive metallic material and accommodating therein the printed circuit board. The housing has a lower extension tube extending towards the infrared sensor and the light emitting element, with the infrared sensor and the light emitting element being accommodated within the lower extension tube. In this case, a light diffusing ring having a through-hole above the infrared sensor and the light emitting element may be further provided, and the infrared sensor is arranged below the through-hole.

There may be provided a second light guide portion separated from the light guide portion by a light shielding wall, in which case the light guide portion is a first light guide portion which is defined by only one first light guide tube having only one longitudinal axis, and the second light guide portion is defined by only one second light guide tube having only one longitudinal axis, with the longitudinal axis of the first light guide tube and the longitudinal axis of the second light guide tube being parallel to each other. Further, the first and second light guide portions are configured such that the infrared rays of light from the article to be heated are guided to the infrared sensor along the only one longitudinal axis of the first light guide tube, and the light emitted from the light emitting element travels along the only one longitudinal axis of the second light guide tube to illuminate in proximity to the infrared incident region.

The induction heating appliance according to a still further different embodiment of the present invention includes a light transmittable top plate provided atop a body and having a heating area for heating an article to be heated with the latter placed thereon; a heating coil disposed below the top plate in face-to-face relation with the heating area for generating magnetic fields necessary to induction heat the article to be heated; an infrared sensor disposed below the top plate for dectecting infrared rays of light; a light emitting element disposed below the top plate; a light guide portion for guiding the infrared rays of light, emitted from the article to be heated, towards the infrared sensor; and a control means for controlling an output of the heating coil based on an output signal from the infrared sensor, characterized in that the top plate is provided with an infrared incident region positioned immediately above an upper opening of the light guide portion at a location inwardly of an outer periphery of the heating coil and offset from a center of the heating coil to guide the infrared rays of light, emitted from the article to be heated, towards the light guide portion, so that rays of light emanating from the light emitting element are emitted within or in proximity to the infrared incident region to allow the rays of light to be noticed within the heating area when viewed from above the body. The infrared incident region is arranged, when viewed from above the body, on a straight line passing across a center of the heating coil and a center of the light emitting portion, which is a region at which the rays of light emitted from the light emitting element are noticeable, or its vicinity and between the center of the heating coil and the center of the light emitting portion.

Effects of the Invention

According to the present invention, since the infrared sensor and the light emitting element are provided below the top plate, and the rays of light emanating from this light emitting element are projected onto the top plate to enable the infrared incident region, which is defined in a part of the heating area, or its proximity to be noticed with eyes, if the user places the article to be heated on the infrared incident region, which forms a light emitting portion then noticed, or the infrared incident region formed in the vicinity of the light emitting portion, the infrared rays of light emanating from a bottom surface of the article to be heated can be efficiently and assuredly guided towards the infrared sensor, so that the temperature of the article to be heated can be controlled through the infrared sensor. Also, even when the ambiance around the induction heating appliance for cooking is dark, the infrared incident region can easily be noticed with eyes.

BRIEF DESCRIPTION OF THE DRAWINGS

FIG. 10 is employed;

EXPLANATION OF REFERENCE NUMERALS

Figure 1:
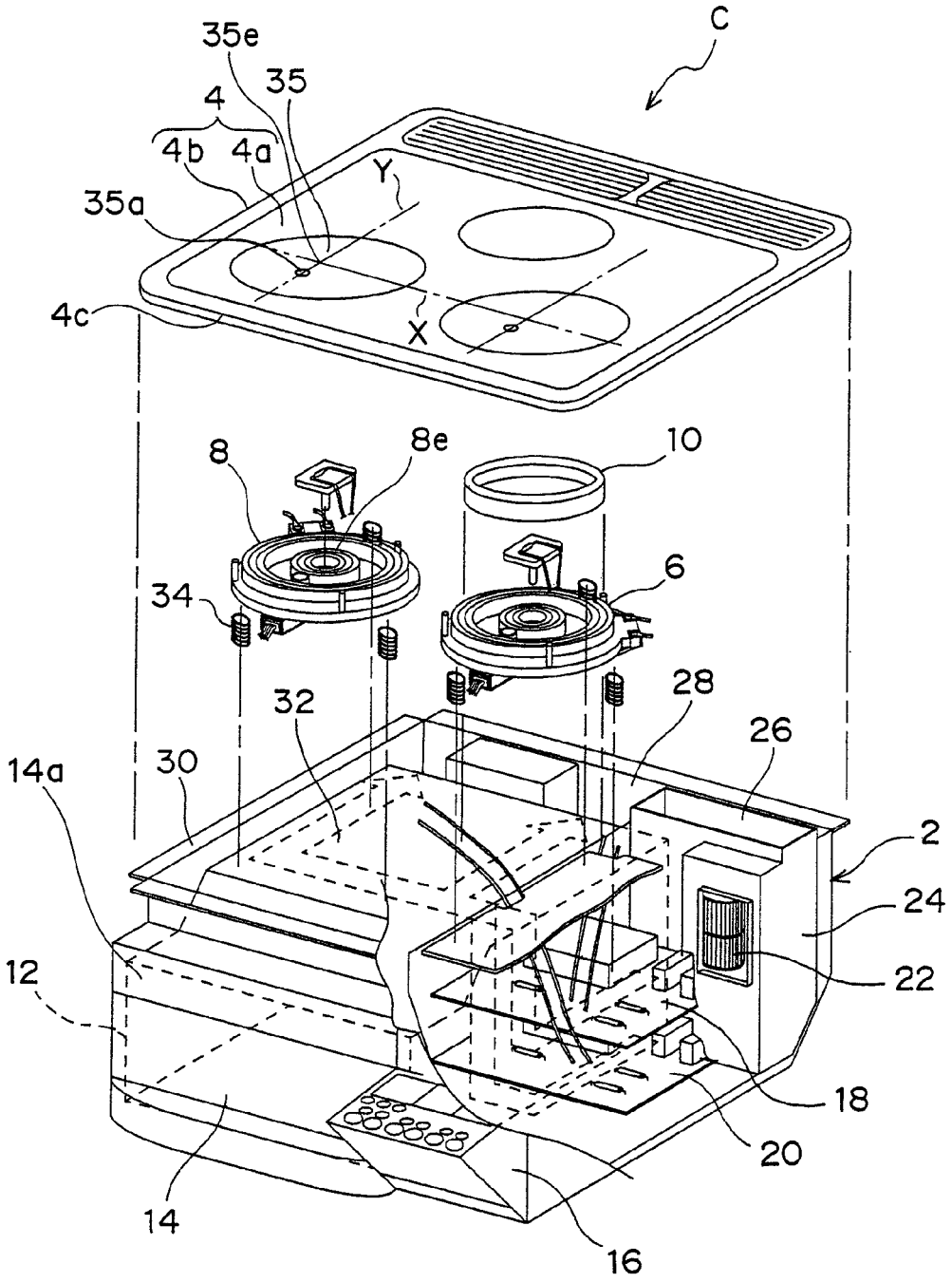
FIG. 1 is an exploded perspective view of an induction heating appliance for cooking according to the present invention.

2: Body
4: Top unit
4a: Top plate
4b: Frame
4c: Front edge
6: First heating coil
8: Second heating coil
8a: Inner coil
8b: Outer coil
8c: Gap
8d: Outer periphery
8e: Center
10: Radiant heater
12: Roaster heating chamber
14: Roaster door
16: Operating console
18: First printed substrate
20: Second printed substrate
22: Cooling fan
24: Air intake duct
26: Air intake port
28: Exhaust port
30: Flange
32: Heat shielding partition wall
34: Support spring
35: Heating area
35a: Infrared incident region
35b: Light emitting region
35c: Printed film
35d: Light absorbing film
35e: Center
36: Heating coil support base
36a: Light guide portion
36b: Recess
36c: Lower opening
36d: Upper opening
36e: Partition wall
36f: Exit port
36g: Mount
36h: Second light guide element
36i: Step
36j: Center
37: Ferrite -continued 38: Thermistor
38a: Thermistor holder
40: Infrared sensor
41: Convex lens
42: Temperature detecting means
44: Control means
46: Inverter circuit
48, 48A, 48B, 48C, 48D, 48E: Sensor unit
50: Unit housing
50a: Shielding portion
52: Printed circuit board
54: Light emitting element
56: Connecting cable
58: Connector
59: Sensor covering
60: Light guide tube (light guide portion)
60a: Upper opening
60b: Lower opening
60c: Lower extension tube
60d: Second light guide tube (second light guide portion)
62: Screw member
67: Light guide element
67b: Light emitting portion
67c: Center
68: Light guide element
68a: Through-hole
68b: Bent portion
70: Light diffusing ring
70a: Through-hole
72: Light sensor
73: Illuminance detecting means
74: Partition wall
76: Light diffusing layer
78: Transparent portion
80: Colored light transmittable layer
A: Article to be heated
C, C1: Induction heating appliance for cooking
X: Transverse center line
Y: Longitudinal center line

DETAILED DESCRIPTION OF THE INVENTION

Preferred embodiments of the present invention will be described hereinafter with reference to the accompanying drawings.

FIG. 1 illustrates an induction heating appliance C for cooking according to the present invention, which is provided with a body 2, a top unit 4 including a light transmittable top plate 4*a*, made of a crystallized ceramic material and fitted to the top of the body 2, and a metallic frame 4*b* disposed around the periphery of the top plate 4*a*, first and second heating coils 6 and 8 arranged below a front portion of the top plate 4*a*, and a radiant heater 10 arranged rearwardly thereof. Also, a roaster heating chamber 12 is provided below the second heating coil 8 positioned on a left side when the body 2 is viewed from front and is selectively opened and closed by a roaster door 14 pivotally fitted to a front surface thereof. A tray (not shown), a grill (not shown) and heaters (not shown) disposed above and below the grill are accommodated within the roaster heating chamber 12, rendering the latter to form a double sided heating roaster.

Also, an operating console 16, through which the output of the above described heating means can be set, is provided on a right side of the front surface of the body 2 and a first printed substrate 18, forming a drive circuit for the first heating coil 6, and a second printed substrate 20 forming a drive circuit for the second heating coil 8 are provided rearwardly thereof and positioned one above the other. A scirocco type cooling fan 22, having a rotary shaft lying in a direction perpendicular to the printed substrates 18 and 20, and a motor (not shown) for driving the cooling fan 22 are provided at a position rearwardly of and proximate to the two printed substrates 18 and 20, and the cooling fan 22 and the motor are enclosed by an air intake duct 24. It is to be noted that respective drive circuits for the radiant heater 10 and a roaster heater are formed inside the printed substrates 18 and 20.

Also, an air intake opening 26, communicated with the air intake duct 24, and an exhaust opening 28 adjoining the air intake opening 26 and on the side adjacent the roaster heating chamber 12 are formed in a rear portion of a top surface of the body 2.

As shown in FIG. 1, the body 2 has an integrally formed outer shell or framework and is of a built-in type capable of being supported in a kitchen by means of a top flange 30 of the outer shell. Only a structure having lax temperature limitations and hard to be thermally damaged, such as including a heat shielding partition wall 32, support springs 34 for the second heating coil 8, a junction terminal block (not shown) for electrically connecting the second heating coil 2 with the second printed substrate 20 and others, is arranged above the roaster heating chamber 12. In addition, when the body 2 is viewed from top, the cooling fan 22, the first printed substrate 18 and the second printed substrate 20 are arranged at a position not overlapping the roaster heating chamber 12 and laterally thereof.

When the induction heating appliance C for cooking of the construction described above in accordance with the present invention is to be used, after an article to be heated A (See FIG. 3.) has been placed on the top plate 4*a* at a location above an arbitrarily chosen one of the heating means including the first heating coil 6, the second heating coil 8 and the radiant heater 10, or a material to be cooked has been loaded into the roaster heating chamber 12, the operating console 16 has to be manipulated to initiate a desired cooking. In order to provide a visual indication of the site where the article to be heated A has to be placed, a heating area 35, where the article to be heated A is placed, is displayed so as to encompass a portion of the top plate 4*a* aligned with each of the heating means 6, 8 and 10, which area 35 is defined by a respective round film 35*c* printed on a rear surface (an undersurface) of the top plate 4*a*. It is to be noted that the heating area may not be limited to a round shape and may not be necessarily matched with the shape of that portion of the top plate 4*a* encompassed by the respective heating means 6, 8 and 10 and may be satisfactory provided that it serves the purpose of providing a visual indication of the position of the respective heating means. Also, the printed film 35*c* used to display the heating area 35 has its outer side (an undersurface) formed with a black colored light absorbing film 35*d*, having a substantially zero light transmittance, by means of a printing technique. It is to be noted that the printed film 35*c* indicative of the heating area 35 may be formed on a front surface, not the rear surface, of the top plate 4*a*. Also, the printed film 35*c* may be in the form of a line of film.

During the use of the induction heating appliance C for cooking, the internal temperature inside the body 2 elevates, but by the effect of the cooling fan 22, the ambient air is sucked into the body 2 through the air intake opening 26 and the sucked air then flows within a space above the printed substrates 18 and 20 and are finally discharged through the exhaust opening 28 by way of a space on the side of the roaster heating chamber 12 within the body 2. As a result thereof, a heating portion within the body 2, including the heating means 6, 8 and 10, is cooled with the temperature thereof decreased consequently.

Hereinafter, of control systems of the induction heating appliance C for cooking, particularly with respect to the respective control systems for the first and second heating coils 6 and 8, reference will be made to the second heating coil 8 by way of example.

Figure 2:
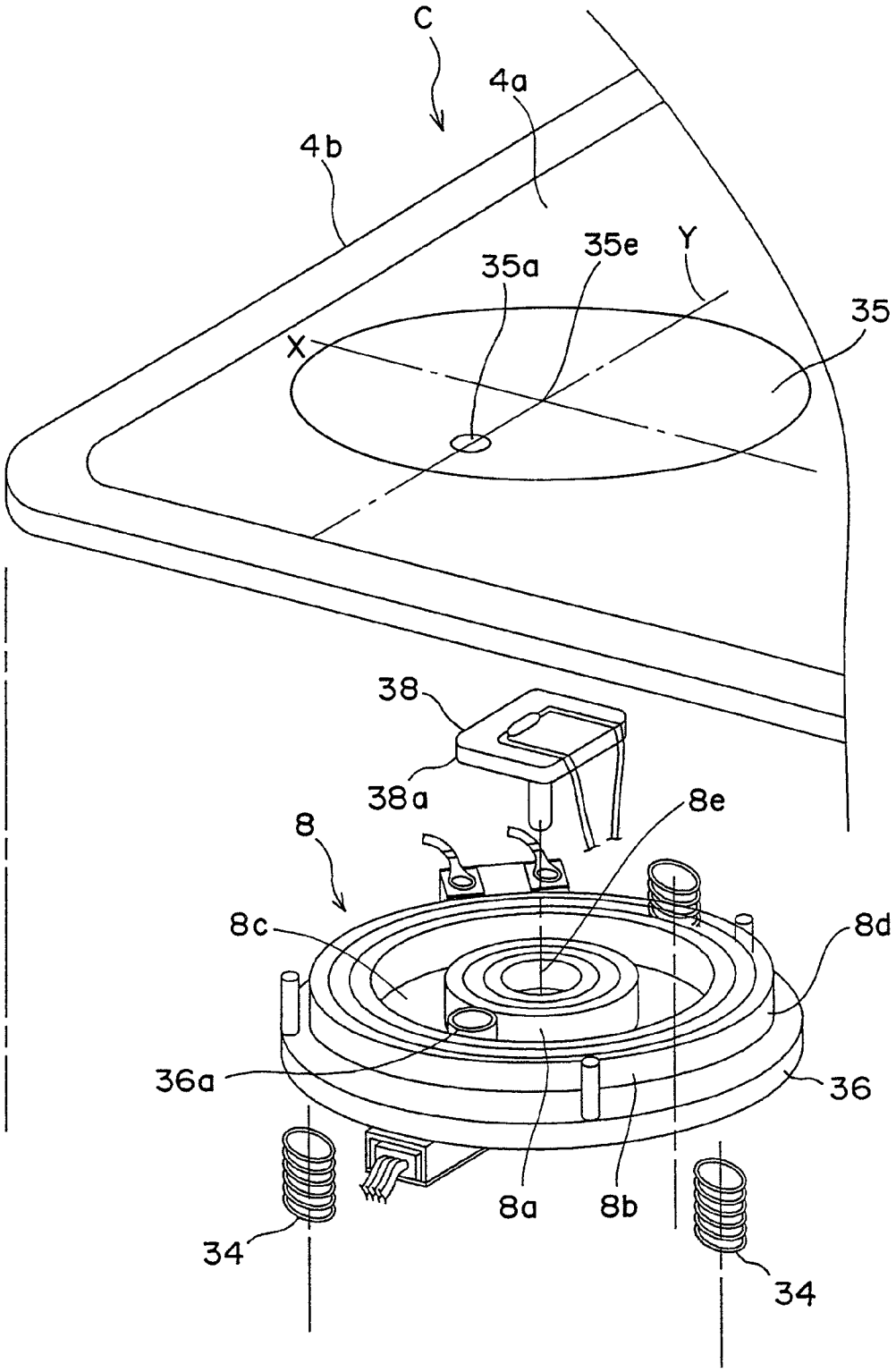
FIG. 2 is an exploded perspective view showing one of heating coils and its proximity provided in the induction heating appliance for cooking shown in FIG. 1.

FIG. 2 illustrates the second heating coil 8 and its surroundings, and the second heating coil 8 has a split winding structure made up of an inner coil 8*a* and an outer coil 8*b* and is retained on a heating coil support base 36 made of a resinous material having a low infrared transmittance. Also, a ferrite 37 (See FIG. 3.) for concentrating magnetic flux, emanating from the second heating coil 8 towards a rear surface thereof, in the vicinity of the second heating coil 8 is fitted to an undersurface of the heating coil support base 36, and a cylindrical light guide portion 36*a* for guiding infrared rays of light emitted from a bottom portion of the article to be heated A (See FIG. 3.) so as to be incident upon an infrared sensor as will be described later, or light emitted from a light emitting element as will be described is formed in a gap 8*c* delimited between the inner coil 8*a* and the outer coil 8*b*. Further, in the vicinity of a center of the second heating coil 8, a thermistor 38 for detecting the temperature of the bottom surface of the article to be heated A is engaged in and supported by a groove of a thermistor holder 38*a*, made of a heat resistant synthetic resin, and is fitted to the top plate 4*a* after having been urged by a spring (not shown) to contact the top plate 4*a*.

Figure 3:
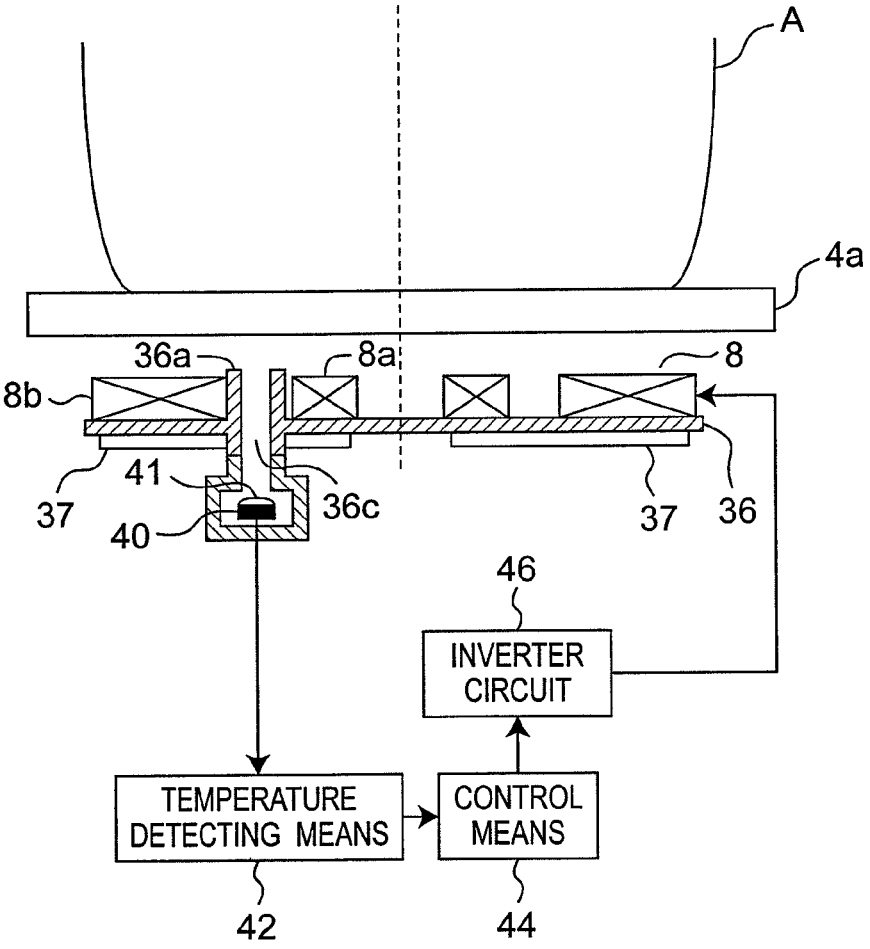
FIG. 3 is a block diagram showing a control circuit for the heating coil.

It is to be noted that the infrared sensor referred to above is provided for detecting the temperature of the article to be heated A in a manner similar to the thermistor 38, but is excellent in temperature response as compared with that of the thermistor 38, and regarding control circuits for the first heating coil 6 and the second heating coil 8 that are controlled in dependence on an output of this infrared sensor, the second heating coil 8 by way of example will be hereinafter described with particular reference to FIG. 3.

As shown in FIG. 3, in order for the infrared sensor 40 to be less susceptible to influences which would be brought about by magnetic flux from the second heating coil 8, the infrared sensor 40 is disposed below the ferrite 37 defining a magnetic path for shielding magnetic flux oriented downwardly from the second heating coil 8 and, also, below a lower open end 36*c* of the cylindrical light guide portion 36*a* formed integrally with the heating coil support base 36. A convex lens 41 is disposed as a light converging means on the path of travel of infrared rays of flight emitted from the bottom surface of the article to be heated A so as to travel towards the infrared sensor 40, so that the infrared rays of flight emitted from the article to be heated A can be collected. An output from the infrared sensor 40 is supplied to a temperature detecting means 42, and the temperature of the article to be heated A is then detected by the temperature detecting means 42. An output from the temperature detecting means 42 is supplied to a control means 44, and the control means 44 then controls an output of an inverter circuit 46 for supplying a high frequency current to the second heating coil 8 in response to the signal from the temperature detecting means 42.

The heating operation performed by the second heating coil 8 of the structure as hereinbefore described will be described hereinafter.

Assuming that the heating is initiated, the inverter circuit 46 supplies a high frequency current of a frequency equal to or higher than 20 kHz to the second heating coil 8 so that the article to be heated A can be self-heated by the effect of an eddy current induced by magnetic flux (magnetic fields) emanating from the heating coil 8. The temperature of the bottom of the article to be heated A at a transit time subsequent to the start of the heating is such that under the influence of a distribution of densities of magnetic flux from the second heating coil 8, an area adjacent an inner edge of the outer coil 8*b* attains a temperature higher than that of a substantial center of the second heating coil 8. Accordingly, in order to detect the temperature at a high temperature area of the article to be heated A, the infrared sensor 40 is disposed below the gap 8*c* delimited between the inner coil 8*a* and the outer coil 8*b* of the second heating coil 8; a detection output from the infrared sensor 40 is outputted to the control means 44 after having been converted by the temperature detecting means 42 into a detected temperature; and if the detected temperature exceeds a predetermined temperature or if the gradient of the detected temperature exceeds a predetermined value, the inverter circuit 46 is controlled by the control means 44 so as to reduce the output thereof.

In the present invention, the infrared sensor 40 is formed as a sensor unit having a light emitting element arranged in the vicinity thereof, and the construction of the sensor unit will now be described with particular reference to FIG. 4.

Figure 4:
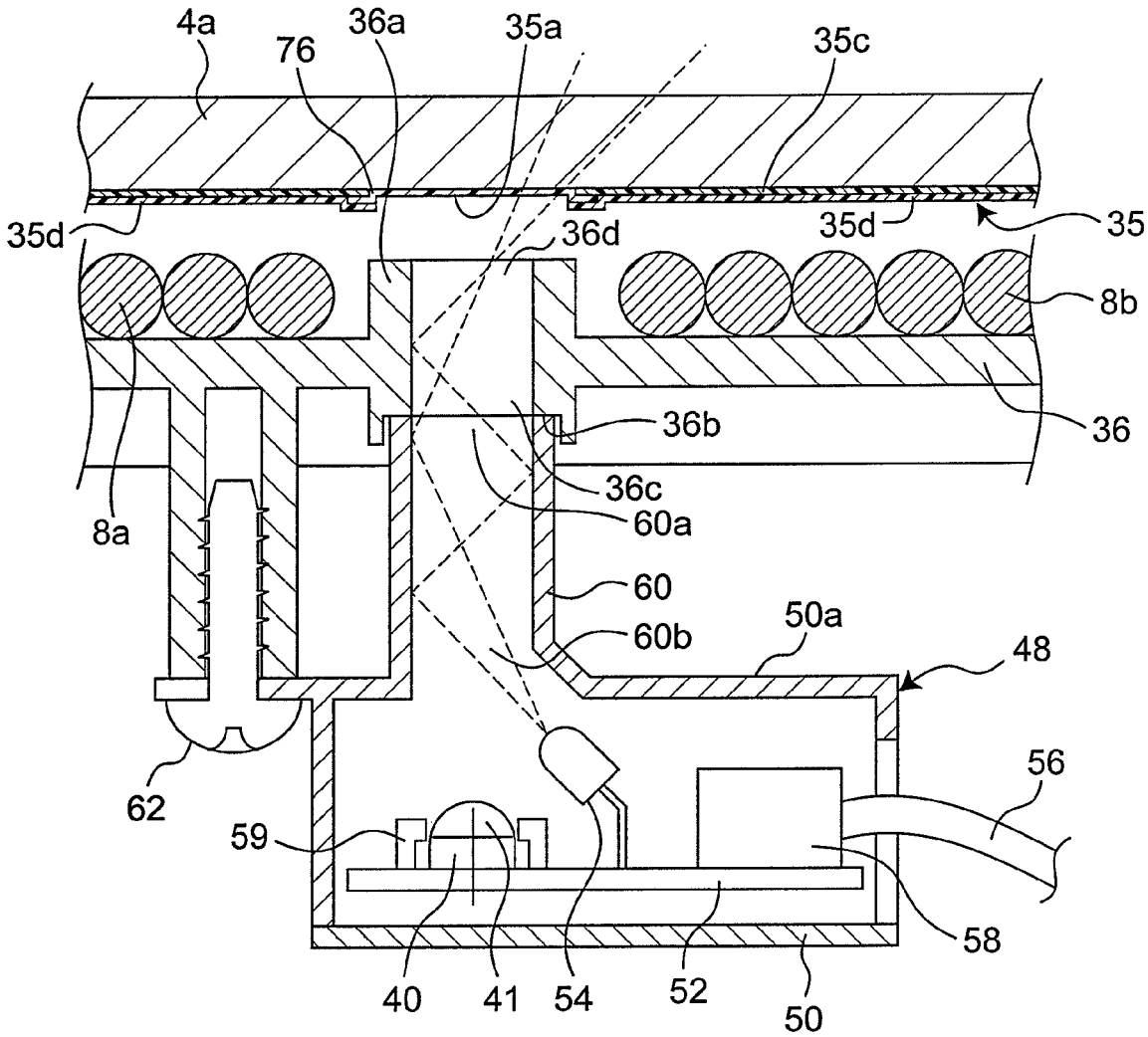
FIG. 4 is a sectional view of a sensor unit provided in the induction heating appliance for cooking shown in FIG. 1.

As shown in FIG. 4, the sensor unit 48 is arranged below the heating coil support base 36 and this sensor unit 48 includes a unit housing 50, made of an electroconductive metallic material such as, for example, aluminum or brass, and a printed circuit board 52 accommodated within the unit housing 50. The infrared sensor 40 and the convex lens 41, and a light emitting element 54 such as, for example, an LED are fixed on the printed circuit board 52, and a connector 58 for electrically connecting those elements and a cable 56 together is provided on the printed circuit board 52. Also, an area around the infrared sensor 40 and a lower portion of the convex lens 41, excluding an infrared incident surface above the convex lens 41, upon which infrared rays of light emitted from the article to be heated A are incident, is enclosed by a tubular sensor covering 59 having a light shielding function, so that light other than the infrared rays of light from the article to be heated A can be prevented from entering the convex lens 41.

The unit housing 50 has a shielding portion 50*a* for magnetically shielding the light emitting element 54 and the infrared sensor 40 provided on one side of the printed circuit board 52 adjacent the second heating coil 8, and a cylindrical light guide tube 60 having an upper opening 60*a*, defined at an upper end thereof, and a lower opening 60*b* defined at a lower end is formed integrally with the shielding portion 50*a* so as to protrude towards the heating area, with the convex lens 41 and the infrared sensor 40 positioned immediately below the lower opening 60*b* of the light guide tube 60. Also, the light emitting element 54 is fixedly mounted on the printed circuit board 52 at a location proximate to the infrared sensor 40 so that rays of light emitted therefrom can be directed towards an inner wall of the light guide tube 60.

Also, a round recess 36*b* is formed in an undersurface of the light guide portion 36*a* of the heating coil support base 36, and this round recess 36*b* has an inner diameter so chosen as to be greater than the outer diameter of the light guide tube 60, and the unit housing 50 is secured to the heating coil support base 36 at a location proximate to the light guide portion 36*a* by means of a screw member 62 in a condition in which the upper end of the light guide tube 60 is received within the round recess 36*b* with an upper end face of the light guide tube 60 tightly contacting an end face of the round recess 36*b*. It is to be noted that the inner diameter of the light guide portion 36*a* and the inner diameter of the light guide tube 60 are so chosen as to be equal to each other and, hence, the light guide portion 36*a* and the light guide tube 60 have respective inner surfaces held in flush with each other.

Also, as hereinabove described, the top plate 4*a* has a round placement area (heating area 35) for the support of the article to be heated A thereon, which area is defined by the printed film 35*c*, but a portion of the printed film 35*c* is formed with a round cutout so as to leave an infrared incident region 35*a*. This infrared incident region 35*a* is defined immediately above an upper opening 36*d* of the light guide portion 36*a* in the heating coil support base 36 so as to confront the upper opening 36*d* and, also, the upper opening 60*a* of the light guide tube 60, and the light transmittance of the infrared incident region 35*a* is so chosen to be higher than the light transmittance of a portion (the printed film 35*c*) peripheral to such infrared incident region 35*a*. It is to be noted that this infrared incident region 35*a* is for the purpose of allowing the infrared rays of light, emitted from a portion of the bottom surface of the article to be heated A, which is aligned with the infrared incident region 35*a*, to pass therethrough towards the light guide portion 36*a*.

When a food material is put into the article to be heated A and is then to be cooked with the induction heating appliance C for cooking, and when an electric power switch (not shown) of the induction heating appliance C for cooking is subsequently turned on, the light emitting element 54 emits rays of light, which are in turn guided, after having been reflected by the inner wall of the light guide portion 60 and the inner wall of the light guide tube 36*a*, and are finally used to illuminate the infrared incident region 35 of the top panel 4*a* through the upper opening 60*a* of the light guide tube 60 and the upper opening 36*d* of the light guide portion 36*a*. Accordingly, since the user can readily ascertain the presence of the infrared incident region 35*a* then illuminated by the light emitted from the light emitting element 54, the heating operation is ready to start when an OFF key (not shown) in the operating console 16 is manipulated. In the case where the second heating coil 8 is to be used, placement of the article to be heated A on the top panel 4*a* so as to cover the area illuminated by the light makes it possible for the infrared sensor 40 to receive assuredly and efficiently the infrared rays of light, emitted from the bottom surface of the article to be heated A and, hence, the temperature of the article to be heated A can be controlled by the infrared sensor 40. Also, even when the ambiance around the induction heating appliance C for cooking is dark, the infrared incident region 35*a* can be readily noticed.

When the article to be heated A is heated by the second heating coil 8, the infrared rays of light emitted from the bottom of the article to be heated A are guided towards the light guide portion 36*a* in the heating coil support base 36 through the infrared incident region 35*a* of the top plate 4*a* and are then guided towards the light guide tube 60 in the unit housing 50, which is held in engagement with the lower opening 36*c* at the lower end of the light guide portion 36*a*, before they are incident upon the infrared sensor 40. In response to the incident infrared rays of light, the infrared sensor 40 generates an output, which is subsequently supplied to the temperature detecting means 42 and, thus, the temperature of the article to be heated A can be controlled in the manner described above.

As hereinabove described, since the outgoing light from the light emitting element 54 is guided towards the top plate 4*a* through the light guide tube 60 and then through the light guide portion 36*a* and, on the other hand, the rays of light emanating from the article to be heated A are guided towards the infrared sensor 40 along the same path, but in a direction reverse to the direction of travel of the outgoing light from the light emitting element 54, that is, through the light guide portion 36*a* and then through the light guide tube 60, the light guide tube 60 and the light guide portion 36*a* function as light guiding means for guiding in both directions. Also, since the light guide tube 60 and the light guide portion 36*a*, which form the light guiding means, extend from a location in the vicinity of a light receiving surface of the infrared sensor 40 to an upper surface of the second heating coil 8, the structure is such that it will be hardly affected by influences brought about by the infrared emission from component parts peripheral to the infrared sensor 40 such as, for example, the second heating coil 8.

While in the foregoing description, reference has been made only to the second heating coil 8 for the purpose of brevity, a similar description equally applies to the first heating coil 6 that is positioned and configured in a manner similar to the second heating coil 8.

As hereinbefore described, since the infrared incident region 35*a* for guiding the infrared rays of light emanating from the article to be heated A towards the light guide portion 36*a* is provided in that portion of the top plate 4*a*, which corresponds in position to the center of the second heating coil 8 and inwardly of the outer periphery of the second heating coil 8, so that the light emitted from the light emitting element 54 can be illuminated within the infrared incident region 35*a* to allow the latter to be noticed within the heating area 35, the user, when he or she places the article to be heated A on the top plate 4*a* so as to cover the infrared incident region 35*a* then noticed as illuminated, can cause the infrared rays of light from the bottom surface of the article to be heated A to be efficiently and assuredly incident upon the infrared sensor 40, with the temperature of the article to be heated A consequently controlled by the infrared sensor 40. Also, even when the ambience around the induction heating appliance C for cooking is dark, the infrared incident region 35*a* can readily be noticed.

Figure 8:
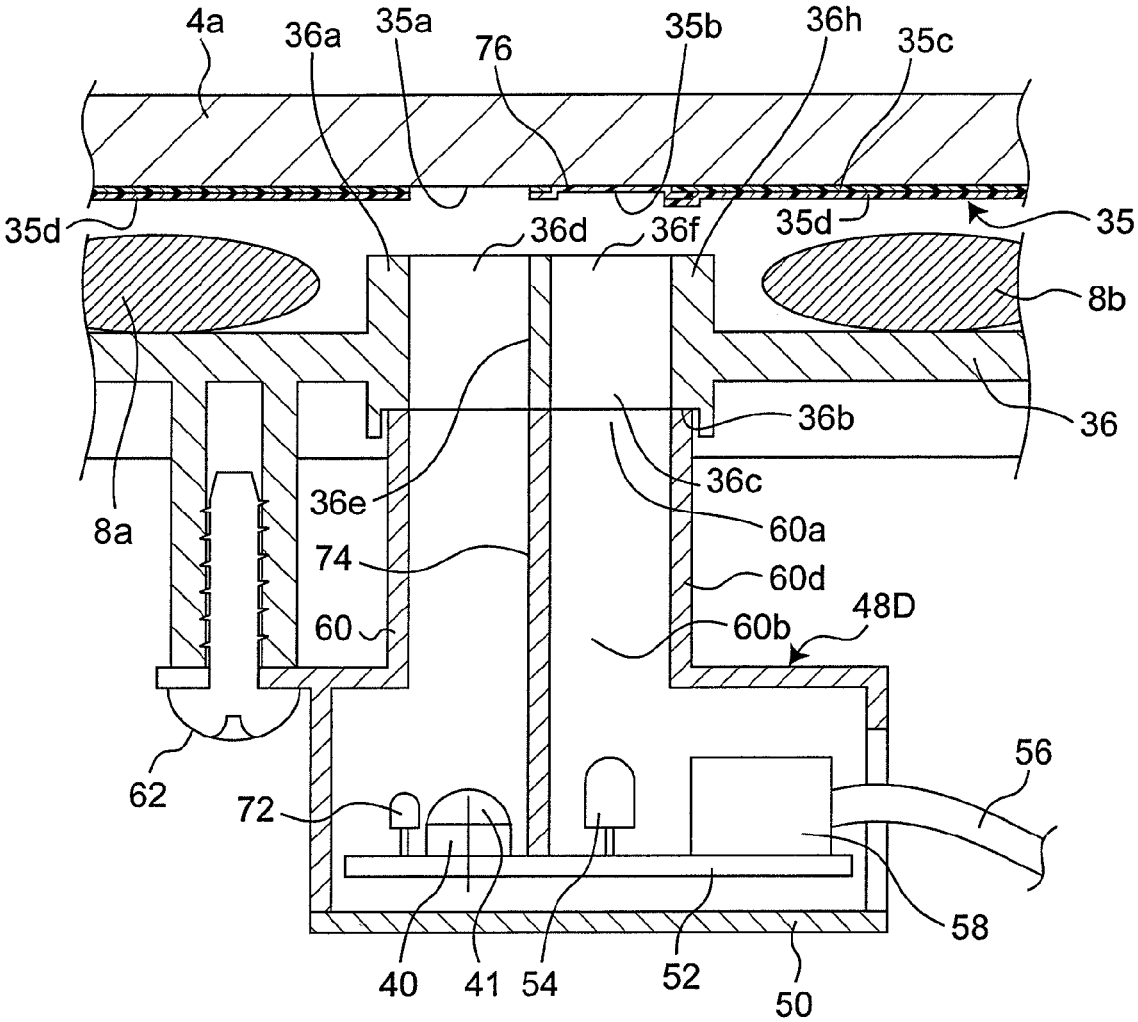
FIG. 8 is a sectional view showing a still further modified form of the sensor unit shown in FIG. 4.
Figure 9:
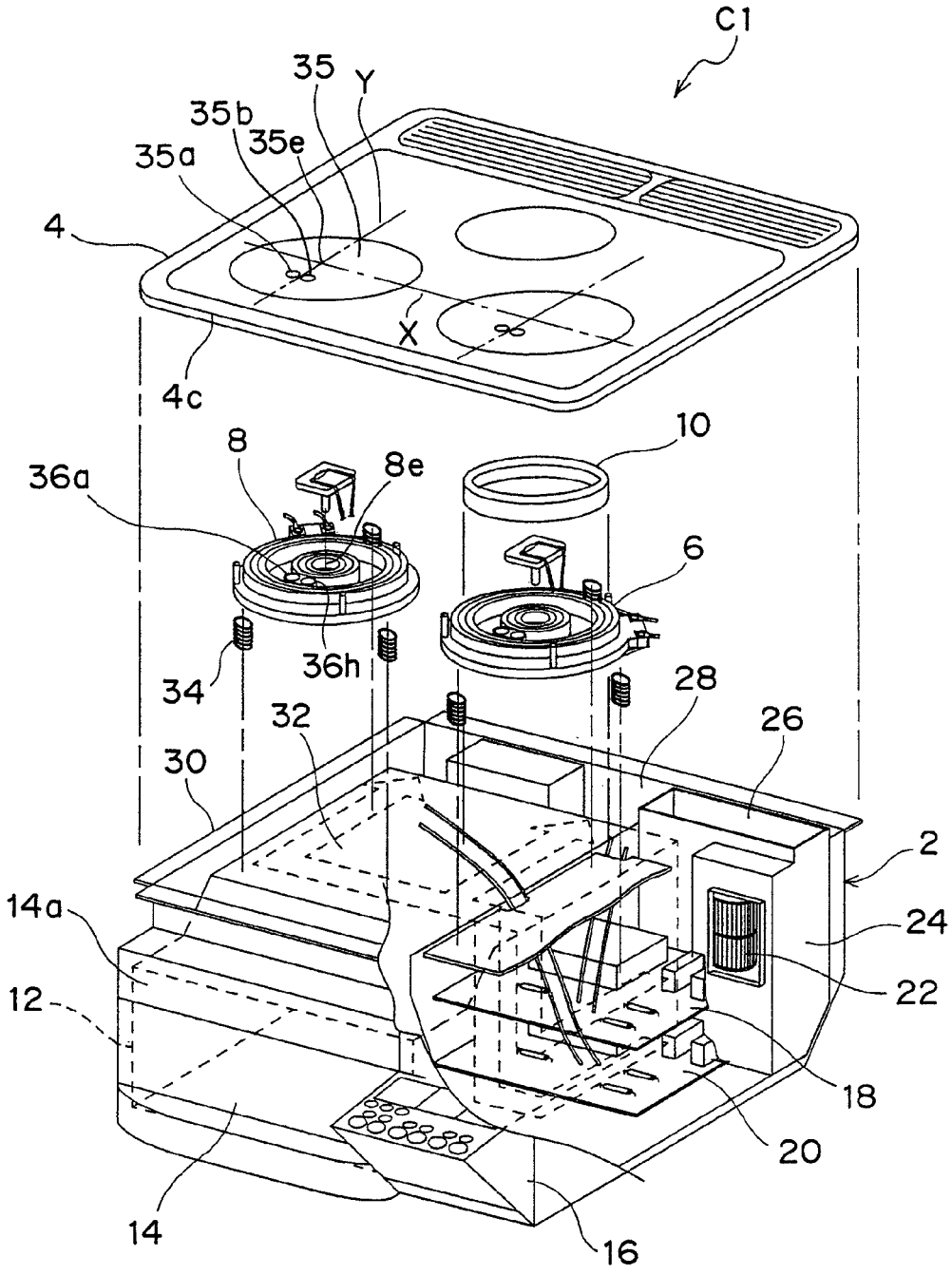
FIG. 9 is an exploded perspective view of the induction heating appliance for cooking, which is provided with the sensor unit shown in FIG. 8.
Figure 10:
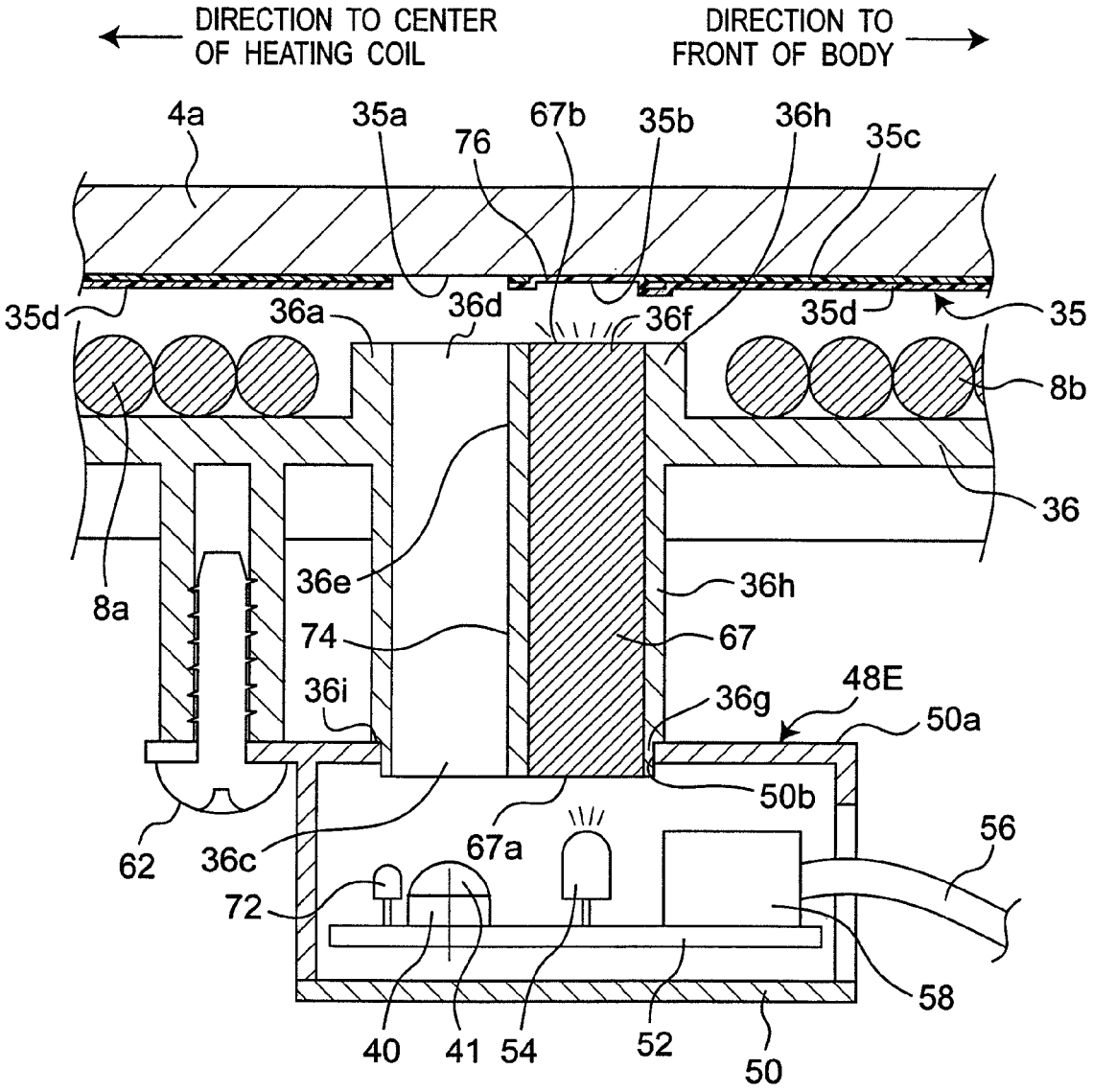
FIG. 10 is a sectional view showing a yet further modified form of the sensor unit shown in FIG. 4.

It is to be noted that similar effects can be obtained even when in place of the arrangement in which the light emitted from the light emitting element 54 is emitted within the infrared incident region 35*a*, as hereinbefore described, so that the light can be viewed within the heating area 35 when viewed from above the body 2, the light emitted from the light emitting element 54 is caused to emit in the vicinity of the infrared incident area 35*a* so that it can be noticed within the heating area 35 when viewed from above the body as will be described later (See FIGS. 8 to 10.).

Also, since the infrared incident region 35*a* is provided only at one location inwardly of the outer periphery 8*d* of the second heating coil 8 and on a straight line, which passes through the center 8*e* of the second hearing coil 8 (or the center 35*e* of the heating area 35) and extends in a direction forwards and rearwards of the body 2 or in the vicinity thereof, or forwardly of the center 8*e* of the second heating coil 8 when viewed from above the body 2, the user can readily cover the infrared incident region 35*a* with the bottom of the article to be heated A, and the infrared sensor 40 and the light emitting element can be constructed inexpensively as one unitary set. Also, since the infrared incident area 35*a* is chosen to be forwardly of the center 8*e* of the second heating coil 8, the user can readily ascertain from the position, where he or she does a cooking work, whether or not the infrared incident region 35*a* is covered by the article to be heated A. When the user after having placed the article to be heated A on the heating area 35 moves the article to be heated A from rear to front, the infrared incident region 35*a* can easily be covered by the bottom surface of the article to be heated A while he or she watches the infrared incident region 35*a*. Conversely, when the article to be heated A is moved from front to rear, the infrared incident region 35*a* then covered up by the article to be heated A from a visible condition can be brought to a visible condition, allowing the user to notice the position of the infrared incident region 35*a*.

Also, positioning of the infrared incident region 35*a* at that location on a center line Y extending in a longitudinal direction, which is a straight line extending in a direction forwardly and rearwardly across the center 8*e* of the second heating coil 8, and forwardly of the center 8*e* of the second heating coil 8 is effective to markedly increase the handling ability by which the user's job of covering the infrared incident region 35*a* can be facilitated.

The reason therefor will be discussed hereinafter. When the article to be heated A is moved, a job of moving it in a direction forwardly and rearwardly from a condition, in which the center 35*e* of the heating area 35 and the center of the bottom surface of the article to be heated A are aligned with each other, can be most conveniently and steadily performed. In view of this, in a condition in which the infrared incident region 35*a* is not covered up by the bottom surface of the article to be heated A while the center 8*e* of the second heating coil 8 (the center 35*e* of the heating area 35) and the center of the bottom of the article to be heated A are aligned with each other, as compared with the case of the infrared incident region 35*a* being positioned at a location spaced the same distance from the center 8*e* in a different direction relative to the center 8*e* of the second heating coil 8, pull of the article to be heated A forwardly results in the infrared incident region 35*a* moving relatively so as to follow the centerline passing across the center of the article to be heated A and, accordingly, the infrared incident region 35*a* can be stably covered up by the bottom surface of the article to be heated A. Conversely, where the infrared incident region 35*a* is covered up by the bottom surface of the article to be heated A while the center 8*e* of the second heating coil 8 and the center of the bottom of the article to be heated A are aligned with each other, as compared with the case of the infrared incident region 35*a* being positioned at a location spaced the same distance from the center 8*e* in a different direction relative to the center 8*e* of the second heating coil 8, it is possible to cause the infrared incident region 35*a* to appear at a position nearest to the user when the article to be heated A is moved in a direction right rearwardly. In this way, by moving the center of the article to be heated A forwardly or rearwardly along the straight line extending in the forward and rearward direction passing across the center 8*e* of the second heating coil 8, the position of the infrared incident region 35*a* can be ascertained in a most readily viewable condition, in the case where the infrared incident region 35*a* is covered by the article to be heated A, and it can be stably covered up in the case where the infrared incident region 35*a* is not covered by the article to be heated A, thus facilitating the handling ability. It is to be noted that the center line X extending in a transverse direction shown in FIG. 1 is a straight line passing across the center 35*e* of the heating area 35 and parallel to a front surface 14*a* of the body 2 (or a front edge 4*c* of the top unit 4). The center 35*e* of the heating area 35 occupies a position immediately above the center 8*e* of the second heating coil 8.

Also, because the light guiding means (the light guide tube 60 and the light guide portion 36*a*) is provided for guiding the infrared rays of light, radiating from the article to be heated A, towards the infrared sensor 40 and also for guiding the light, emitted from the light emitting element 54, towards the infrared incident region 35*a*, and because the rays of light emitted from the light emitting element 54 and then guided by the light guiding means 60 and 36*a* are projected onto the top plate 4*a* through the upper opening 36*d* of the light guide portion 36*a*, which is an opening of the light guiding means 60 and 36*a*, to enable the infrared incident region 35*a* to be partly or entirely viewable, the infrared incident region 35*a* itself is designed to emit light and, accordingly, the infrared incident region 35*a* can be assuredly covered up by the article to be heated A. Also, since the outgoing light from the light emitting element 54 is guided towards the top plate 4*a* through the light guide tube 60 and then through the light guide portion 36*a* and, on the other hand, the infrared rays of light emanating from the article to be heated A are guided towards the infrared sensor 40 along the same path, but in a direction reverse to that described above, through the light guide portion 36*a* and then through the light guide tube 60, the light guide tube 60 and the light guide portion 36*a* function as the bidirectional light guiding means, making it possible to provide a simplified and space-saving construction. It is to be noted that where the light from the light emitting element 54 will adversely affect the detecting operation of the infrared sensor 40, it is recommended to cease the detecting operation of the infrared sensor 40 during the length of time the light emitting element 54 is active to emit the light or, alternatively, to employ a wavelength region of the infrared sensor 40 to be detected, which is different from the wavelength of light from the light emitting element 54.

Also, since the sensor unit 48 is constructed with the infrared sensor 40 and the light emitting element 54 and includes the printed circuit board 52 for fixing and electrically connecting the infrared sensor 40 and the light emitting element 54 and the unit housing 50 made of the electroconductive metallic material and accommodating therein the printed circuit board 52; since the unit housing 50 has the shielding portion 50*a* for electromagnetically shielding the infrared sensor 40 and the light emitting element 54 both provided on the side of the printed circuit board 52 adjacent the second heating coil 8; and since the light guiding means (the light guide tube 60 and the light guide portion 36*a*) is formed integrally with the shielding portion 50*a* so as to protrude in a direction towards the heating area 35, not only can the sensor unit 48 be assembled compact in size, but the assemblage can be also facilitated, thus rendering the infrared sensor 40 and the light emitting element 54 to be hardly affected by noises originating from an inverter and the second heating coil 8.

Figure 5:
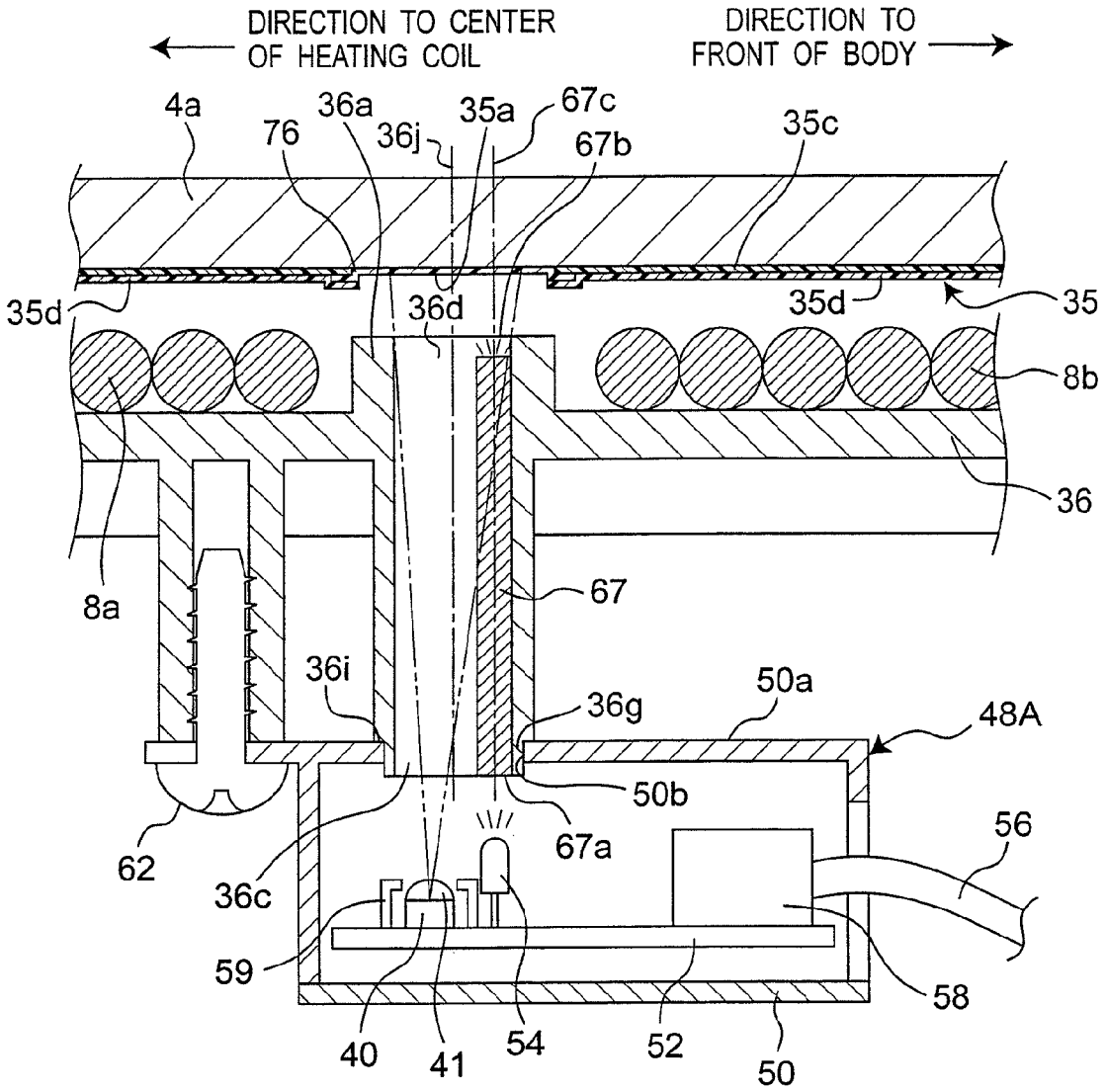
FIG. 5 is a sectional view showing a modified form of the sensor unit shown in FIG. 4.

FIG. 5 illustrates a modified form of the sensor unit 48 shown in FIG. 4, and the sensor unit 48A shown in FIG. 5 is not provided with the light guide tube 60 of the sensor unit 48 shown in FIG. 4. The light guide portion 36*a* is extended downwardly with the lower opening 36*c* brought to a position close to the infrared sensor 40. A step 36*i* is formed in the vicinity of the lower end of the light guide portion 36*a* and, when the unit housing 50 is threaded to the heating coil support base 36 by means of the screw member 62, a mount 36*g* below the step 36*i* extends through a hole 50*b*, defined in the shielding portion 50*a*, with the light guide portion 36*a* engaged consequently with the shielding portion 50*a*. The inner wall of the light guide portion 36*a* is colored black so that rays of light can be absorbed thereby. The convex lens 41 (the light collecting means) is arranged on the path along which the infrared rays of light are guided from the article to be heated A towards the infrared sensor 40, so that the infrared rays of light emanating from the article to be heated A and passing through the infrared incident region 35*a* can be guided towards the infrared sensor 40.

Since the inner wall of the light guide portion 36*a* is so colored black as to absorb the light, the field of view of the infrared sensor 40 is limited by the upper opening 36*d*. By this construction, it is possible not only to simplify the construction, but also to reduce the heat, which will be transmitted from the second heating coil 8 and/or the article to be heated A to the infrared sensor 40, when the light guide path for the travel of the infrared rays of light therethrough is formed by a part of the light guide portion 36*a* which is a resinous article.

Also, a rod-like light guide element 67 is inserted and fixed to a portion of the inner wall of the light guide portion 36*a* on one side offset towards the frontward direction. This light guide element 67 has, at its lower end, an incident face 67*a* opposed to the light emitting element 54 and also has, at its upper end, a light emitting face 67*b* opposed to the infrared incident region 35*a* in the top plate 4*a*.

Rays of light emerging outwardly from the light emitting face 67*b* illuminate the infrared incident region 35*a* and, accordingly, the user can notice such light within the infrared incident region 35*a*. Thus, since when viewed from above the body 2, the infrared incident region 35*a* is disposed on the straight line passing across the center 8*e* of the second heating coil 8 and the center of the light emitting face 67*b* of the light guide element, which is a region where the rays of light emitted from the light emitting element 54 can be viewable, or its proximity and between the center 8*e* of the second heating coil 8 and an approximate center of the light emitting face 67*b*, it is possible to assuredly place the bottom surface of the article to be heated A above the infrared incident region 35*a* when the bottom surface of the article to be heated A is covered by a light emitting portion 67*b*. It is to be noted that a light shielding coating, which is, for example, black in color, may be applied to a lateral side face of the light guide element 67 to avoid leakage of light therefrom.

Figure 6:
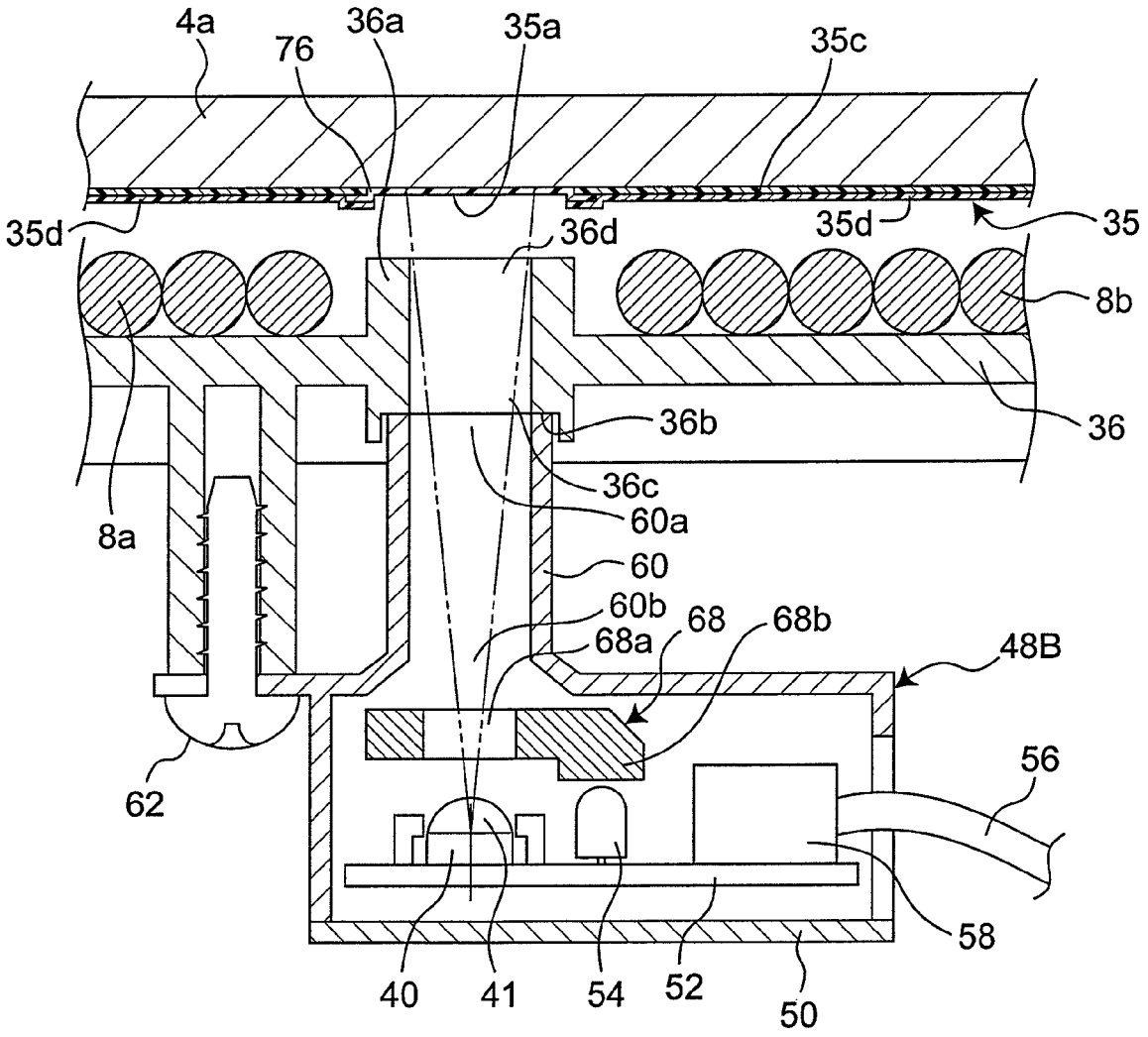
FIG. 6 is a sectional view showing another modified form of the sensor unit shown in FIG. 4.

FIG. 6 illustrates another modified form of the sensor unit 48 shown in FIG. 4, and the sensor unit 48B shown in FIG. 6 is of a structure, in which a light guide element 68 is disposed above the infrared sensor 40 and the light emitting element 54.

The light guide element 68 is formed in an annular shape having its center formed with a round through-hole 68*a*, and a part thereof is formed with a bent portion 68*b* so as to confront a light emitting portion of the light emitting element 54. Rays of light emerging from the light emitting element 54 are incident upon the light guide element 68 from an end face of the bent portion 68*b*, the light guide element 68 having the through-hole 68*a* defined at the center thereof is illuminated in its entirety, and an annulus of light exits towards the article to be heated A, with an upper face of the light guide element 68 serving as a light emitting face from which that annulus of light emerges outwardly. Also, the infrared rays of light from the article to be heated A are incident upon the infrared sensor 40 through the through-hole 68*a* of the light guide element 68.

Since the foregoing construction is such that the light from the light emitting element 54 is injected; the light guide element 68 capable of allowing the light to emerge outwardly in the form of an annulus of light is further provided; and the annulus of light guided from the light emitting face of the light guide element 68 towards the light guiding means (the light guide tube 60 and the light guide portion 36*a*) exits so as to travel towards the article to be heated A, some advantages can be obtained that the amount of light used to illuminate the infrared incident region 35*a* can be increased and that the infrared incident region 35*a* can be uniformly illuminated.

Also, since the infrared rays of light radiated from the article to be heated A are guided towards the infrared sensor 40 through the upper opening 36*d* of the light guide portion 36*a* and then through the through-hole 68*a* defined inside the light emitting face of the light emitting element 54, it is possible to avoid the possibility that the collecting of the infrared rays of light from the article to be heated A may be disturbed.

Figure 7:
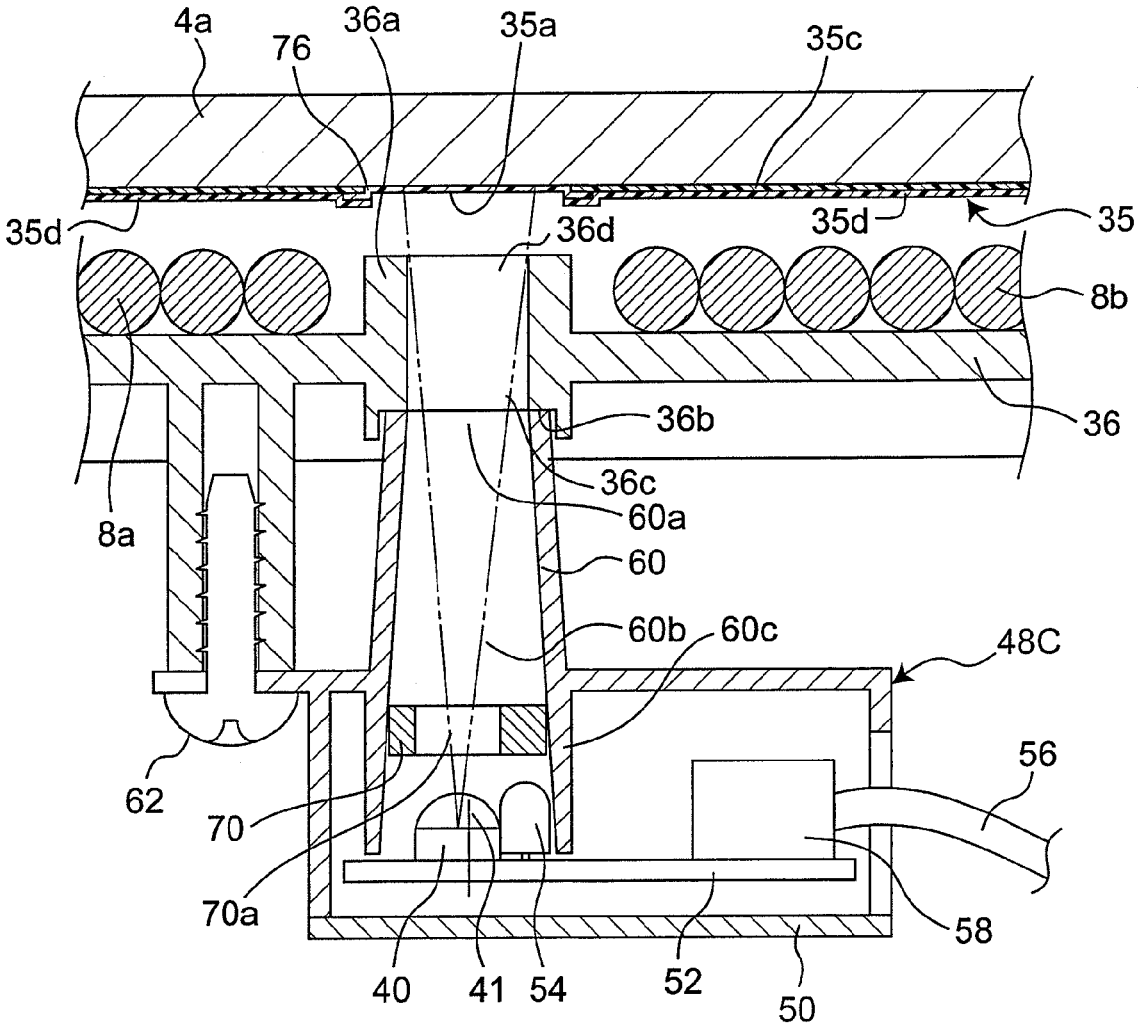
FIG. 7 is a sectional view showing a further modified form of the sensor unit shown in FIG. 4.

FIG. 7 illustrates a further modified form of the sensor unit 48 shown in FIG. 4, and the sensor unit C shown in FIG. 7 is of a structure, in which the light guide tube 60 in the unit housing 50 is extended to a position adjacent the printed circuit board 52 or its proximity, and the infrared sensor 40 and the light emitting element 54, which are positioned in proximity to each other, are accommodated within a lower extension tube 60*c* continued from the light guide tube 60. Also, a light diffusing ring 70 having a round through-hole 70*a* is provided above the infrared sensor 40 and the light emitting element 54, and the infrared sensor 40 is disposed below the through-hole 70*a* while the light emitting element 54 is disposed below a site other than the through-hole 70*a*.

This construction is effective not only to prevent light inside the appliance or external light leaking through a gap in the unit housing 50 in the vicinity of, for example, the connector 58 from being incident upon the infrared sensor 40 to thereby increase the light collecting property, but also to reduce the leakage of the light emitted from the light emitting element 54 so that the brightness of the exit light from the top plate 4*a*, which the user can notice, can be increased, since the unit housing 50 includes the lower extension tube 60*c* extending towards the printed circuit board 52 with the infrared sensor 40 and the light emitting element 54 accommodated within the lower extension tube 60*c*. Also, since the light diffusing ring 70 having the through-hole 70*a* is provided above the infrared sensor 40 and the light emitting element 54, and the infrared sensor 40 is disposed below the through-hole 70*a*, the light emitted from the light emitting element 54 is in the form of a planar light, not a pencil of light, with the uniformity increased consequently.

FIG. 8 illustrates a still further modified form of the sensor unit shown in FIG. 4, and the sensor unit 48D shown in FIG. 8 is of a structure, in which a light sensor 72 is disposed in the vicinity of the infrared sensor 40, and a partition wall 74 for separating both of the infrared sensor 40 and the light sensor 72 from the light emitting element 54 is formed integrally with the unit housing 50. Also, the light guide portion 36*a* in the heating coil support base 36 has its interior similarly formed integrally with a partition wall 36*e* dividing the interior into two chambers, and the light guide portion 36*a* has its upper end formed with an upper opening 36*d* and an exit port 36*f*. The top plate 4 has its rear surface printed with a colored printed film 35*c*, which is colored in, for example, a silver color, and the light emitting region 35*b* is not printed with any colored printed film 35*c* but is formed with a light diffusing layer 76. The infrared incident region 35*a* is not printed with any colored printed film 35*c*. Since the infrared incident region 35*a* is formed with the printed film, which is colored in black or dark brown color, but is capable of transmitting infrared rays of light therethrough, for concealing the interior from view, the user can recognize the infrared incident region 35*a* as a black window if the colored printed film 35*c* is of a bright color such as, for example, a silver color.

FIG. 9 illustrates an induction heating appliance C1 for cooking having the sensor unit 48D of the structure shown in FIG. 8, and the light guide portion 36*a* in the heating coil support base 36 and the light guide tube 60, both cooperating with each other to form the light guiding means, have an overall outer sectional shape representing a substantially elliptical shape and, at the same time, a path (the light guide portion 36*a*) of travel of the infrared rays of light incident on the infrared sensor 40 and a path (a second light guide portion 36*h*) of travel of the light emitted from the light emitting element 54, which are separated from each other by the partition walls 36*e* and 74, have respective horizontal sections representing a substantially round shape. The respective horizontal sectional shapes of the light guide tube 60 and the second light guide tube 60*d* are identical with those of the light guide portion 36*a* and the second light guide portion 36*h*. When viewed from above the body 2, the infrared incident region 35*a* and a light emitting region 35*b* are positioned at respective locations displaced inwardly of the heating area 35, that is, inwardly of the outermost periphery of the second heating coil 8 and forwardly along the direction forwards and rearwards from the center 8*e* of the second heating coil 8 (which direction is, in the illustrated instance, referred to as a direction perpendicular to the front edge 4*c* of the top unit 4 or in a direction perpendicular to the front surface 14*a* of the body 2) and, when viewed from front of the body 2, the both are laterally juxtaposed relative to each other in a direction leftwards and rightwards (in a transverse direction). In other words, when viewed from above (in a top plan representation), the infrared incident region 35*a* and the light emitting region 35*b* are juxtaposed relative to each other on respective sides of a longitudinal center line Y, which is a straight line passing across the center of the second heating coil 8 (the center of the heating area 35) in the direction forwards and rearwards (in the longitudinal direction). The transverse center line X in FIG. 9 is a straight line extending across the center 35*e* of the heating area 35 (the center 8*e* of the second heating coil 8 when viewed from above) and parallel to the front surface 14*a* of the body 2, and the infrared incident region 35*a* and the light emitting region 35*b* are laid parallel to the straight line X.

As hereinabove described, since the top plate 4*a* is formed with the light emitting region 35*b*, corresponding to the path of travel of the light emitted from the light emitting element 54, and the infrared incident region 35*a*, corresponding to the path of travel of the infrared rays of light to be incident upon the infrared sensor 40, in a fashion close towards, but separated from each other, not only can the field of view of the infrared sensor 40 be narrowed, but the light emitted from the light emitting element 54 can be also efficiently guided towards the light emitting region 35*b*. Also, influences which the exit light from the light emitting element 54 may bring about on the infrared sensor 40 can be suppressed.

Figure 11:
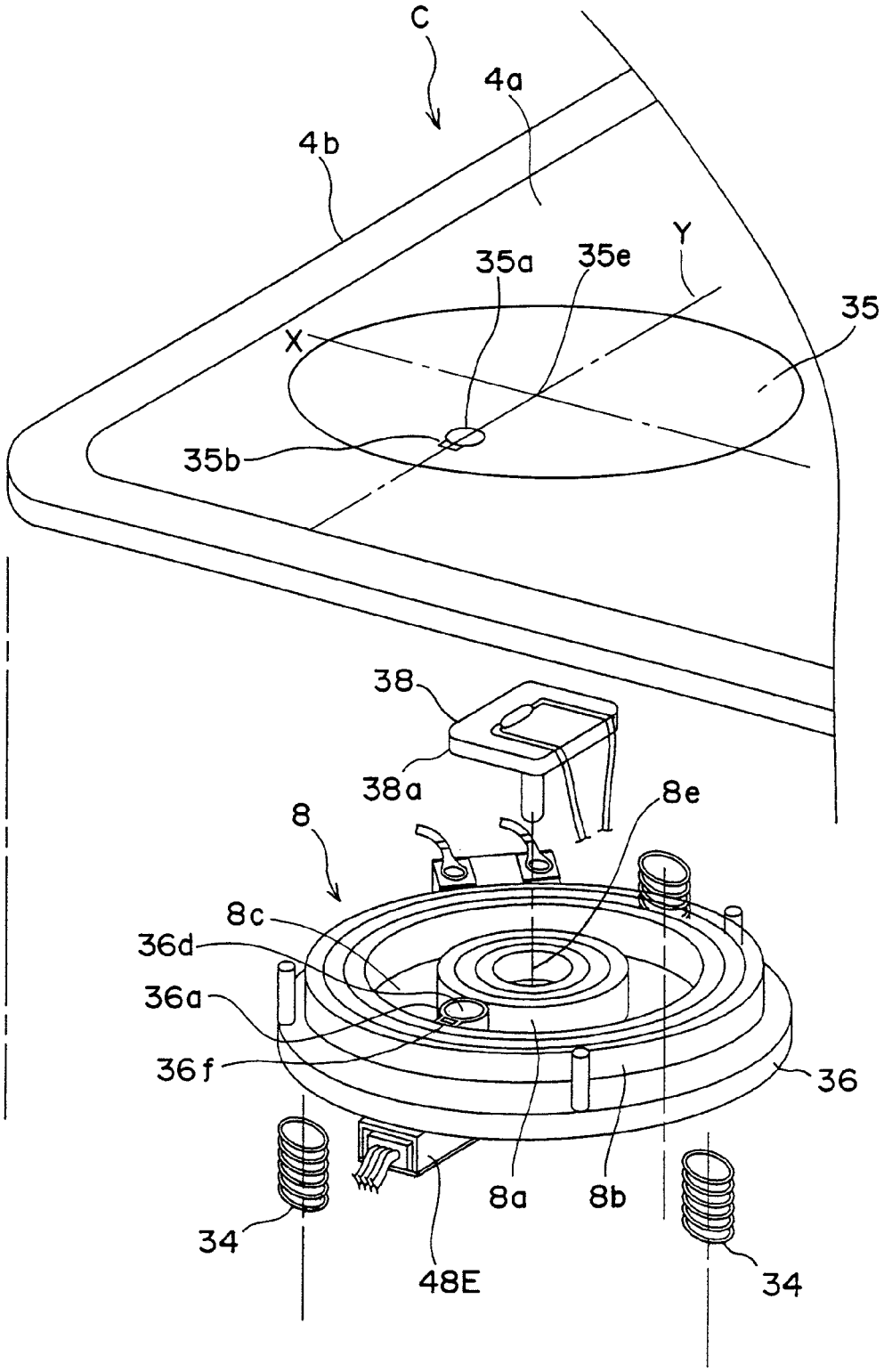
FIG. 11 is an exploded perspective view showing the heating coil, which is provided with the sensor unit shown in FIG. 10, and its proximity.

FIG. 10 illustrates a yet further modified form of the sensor unit shown in FIG. 4, and the sensor unit 48E shown in FIG. 10 differs from the sensor unit 48D shown in FIG. 8 in that, as is the case with the construction shown in FIG. 5, the light guide portion 36*a* shown in FIG. 8 is extended downwardly with the lower opening 36*c* positioned in proximity to the infrared sensor 40 and that, as shown in FIG. 11, the light emitting region 35*b* and the infrared incident region 35*a* are displaced from the center of the second heating coil 8 in the direction forwards and rearwards (in the longitudinal direction) and forwardly. The step 36*i* is formed in the vicinity of the lower end of the light guide portion 36*a*. When the unit housing 50 is threaded to the heating coil support base 36 by means of the screw member 62, a mount 36*g* downwardly of the step 36*i* is engaged with the shielding portion 50*a*. By this construction, the path of travel of the infrared rays of light, limiting the field of view of the infrared sensor 40, and the path of travel of light emitted from the light emitting element 54 can be formed in a single component part for simplification and, also, the heat, which may be transmitted from the second heating coil 8 and the article to be heated A to the infrared sensor 40, can be reduced. Also, a rod-like light guide element 67 is inserted and fixed to a portion of the inner wall of the light guide portion 36*a* on one side offset towards the frontward direction. This light guide element 67 has, at its lower end, an incident face 67*a* opposed to the light emitting element 54 and also has, at its upper end, a light emitting face 67*b* opposed to the infrared incident region 35*a* in the top plate 4*a*. Rays of light emerging outwardly from the light emitting face 67*b* illuminate the infrared incident region 35*a* and, accordingly, the user can notice such light within the infrared incident region 35*a*.

FIG. 11 illustrates the second heating coil 8, which is provided with the sensor unit E, and its proximity. Although in FIG. 9, the light emitting region 35*b* and the infrared incident region 35*a* have been shown and described as juxtaposed to each other in the direction leftwards and rightwards (in the transverse direction), as viewed from front, and have been displaced forwardly from the center of the second heating coil 8 in the direction forwards and rearwards (in the longitudinal direction), the article to be heated A can cover the infrared incident region 35*a* and be heated with an increased handling ability if the light emitting region 35*b* is juxtaposed forwardly in the direction forwards and rearwards (in the longitudinal direction) from the center of the second heating coil 8 as shown in FIG. 11. In other words, the user generally places the article to be heated A with the center of the bottom surface thereof matched with the center 8*e* of the second heating coil 8. Where in this condition the bottom diameter of the article to be heated A is sufficiently large enough to permit the bottom surface thereof to cover the infrared incident region 35*a*, it is possible to allow the infrared incident region 35*a* to be stably covered with the article to be heated A while the distance from the position of the infrared incident region 35*a* to an end of the bottom surface of the article to be heated A in the transverse direction (as viewed from front) remains the same in either side in the leftward and rightward directions. In the event that the bottom diameter of the article to be heated A is not sufficiently large, and the infrared incident region 35*a* cannot be covered when the article to be heated A is placed with the center of the bottom surface thereof matched with the center 8*e* of the second heating coil 8, the article to be heated A can be placed at the position where the infrared incident region 35*a* can be stably covered with the bottom surface of the article to be heated A, and the distance from the position of the infrared incident region 35*a* to that end of the bottom surface of the article to be heated A in the transverse direction (as viewed from front) remains the same in either side in the leftward and rightward directions by moving the article to be heated A forwardly while watching the infrared incident region 35*a*, Also, since the infrared incident region 35*a* is provided between the light emitting region 35*b* and the center 8*e* of the second heating coil 8, placement of the article to be heated A on the heating area 35 so as to cover the light emitting region 35*b* is effective to assuredly cover the infrared incident region 35*a* with the article to be heated A.

Similarly, not only in the case in which the light emitting region 35*b* and the infrared incident region 35*a* are displaced in the direction forwards and rearwards (in the longitudinal direction) from the center of the second heating coil 8 and forwardly, but also in the case where the light emitting region 35*b* and the infrared incident region 35*a* are displaced from the center 8*e* of the second hearing coil 8, it is preferred that the light emitting region 35*b* be arranged at a location radially outwardly of the center 8*e* of the second heating coil 8, because the infrared incident region 35*a* can be stably covered with the article to be heated A by covering the light emitting region 35*b* with the article to be heated A.

Figure 12:
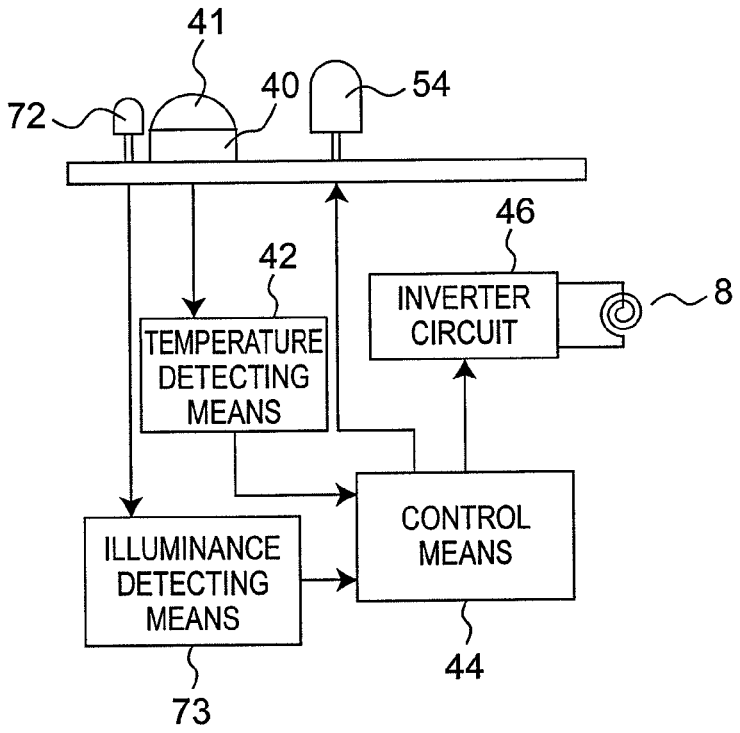
FIG. 12 is a block diagram showing the control circuit applicable where the sensor unit shown in FIG. 8

FIG. 12 illustrates a control circuit for the second heating coil 8, which can be employed where the sensor unit 48D shown in FIG. 8 or the sensor unit 48E shown in FIG. 10 is employed. In addition to the control circuit shown in FIG. 3, an illuminance detecting means 73 adapted to receive an output from the light sensor 72 is provided, and the control means 44 is operable to control an output from the inverter circuit 46 for supplying a high frequency current to the second heating coil 8 in dependence on an output from the temperature detecting means 42 and an output from the illuminance detecting means 73.

In other words, the light sensor 72 is to detect the illuminance (or the brightness) of ordinary indoor light, and the illuminance detecting means 73 is operable in response to an output signal from the light sensor 72 to compare the illuminance, detected by the light sensor 72, with a predetermined threshold value. In the event that the illuminance detected by the light sensor 72 attains a value higher than a predetermined value, it is determined that the article to be heated A fails to cover the infrared incident region 35*a*, in which case the control means 44 disables a heating control of the second heating coil 8 by the inverter circuit 46 or suppresses the output of the second heating coil 8, but in the event that the illuminance detected by the light sensor 72 attains a value lower than the predetermined value, it is determined that the article to be heated A covers the infrared incident region 35*a*, in which case the control means 44 performs the heating control of the second heating coil 8 by the inverter circuit 46.

Accordingly, the control means 44 performs an output control of the inverter circuit 46 in response to the output signal from the infrared sensor 40 only when the illuminance detected by the light sensor 72 is lower than the predetermined value, thereby to control the heating output from the second heating coil 8 so that the temperature or the temperature gradient of the article to be heated A may be lower than a predetermined value.

By the construction described above, since the light emitting region 35*b* is illuminated in the vicinity of the infrared incident region 35*a*, the position of the infrared incident region 35*a* can easily be noticed and, even when the indoor space is dark, the infrared incident region 35*a* can easily be noticed.

Also, since the light sensor 72 can detect the illuminance within the indoor space, it is possible to detect that the article to be heated A is not in position to cover the infrared incident region 35*a*, but where the indoor space is dark, it is difficult for the light sensor 72 to detect that the article to be heated A is not in position to cover the infrared incident region 35*a*. However, since even in such case, the light emitting region 35*b* can readily be noticed with eyes due to the light emission, the temperature control of the article to be heated A by means of the infrared sensor 40 can be performed stably if the light emitting region 35*b* is covered to permit the infrared incident region 35*a* to be covered.

It is to be noted that although the surface area of the light emitting region 35*b* is small and, therefore, any displacement in position between the upper opening 36*d*, through which light is projected, and the light emitting 35*b* will be conspicuously visible, the provision of the light diffusing layer in the light emitting region 35*b* in the manner as hereinbefore described can minimize the visibility of the displacement in position. The construction in which the light diffusing layer is provided will now be described with particular reference to FIGS. 13A to 13E.

Figure 13A:
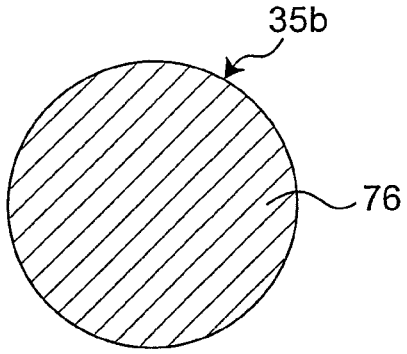
FIG. 13A is a front elevational view in the case where a light diffusing layer is formed in a light emitting region provided in a top plate of the induction heating appliance for cooking.

The construction shown in FIG. 13A is such that a semitransparent light diffusing layer 76 is provided over the entire area of the light emitting region 35*b*, whereas the construction shown in each of FIGS. 13B to 13E is such that the light emitting region 35*b* is provided with a light diffusing layer 76 mixed together with a site having a higher light transmittance than that of the light diffusing layer 76.

Figure 13B:
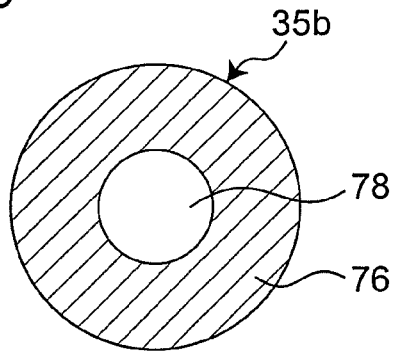
FIG. 13B is a front elevational view in the case where another light diffusing layer is formed in the light emitting region provided in the top plate of the induction heating appliance for cooking.

To describe further, the structure shown in FIG. 13B is such that a center area of the light emitting region 35*b* is rendered to be a transparent area 78, where no light diffusion layer exists; a peripheral area is provided in a stripe shape at a location radially outwardly of this center area and is formed by a semitransparent annular light diffusing layer 76; and the light transmittance of the center area is chosen to be higher than that of the peripheral area.

Figure 13C:
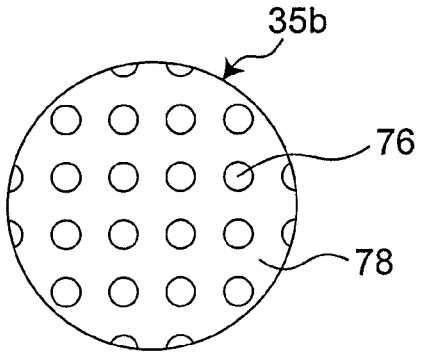
FIG. 13C is a front elevational view in the case where a further light diffusing layer is formed in the light emitting region provided in the top plate of the induction heating appliance for cooking.

Also, the construction shown in FIG. 13C is such that a plurality of semitransparent round light diffusing layers 76 are provided in the light emitting region 35*b* in a scattered fashion and an area other than the light diffusing layers 76 is rendered to be a transparent area 78.

Figure 13D:
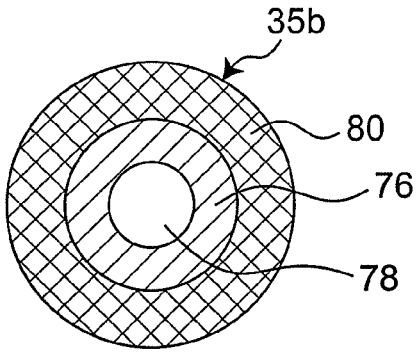
FIG. 13D is a front elevational view in the case where a still further light diffusing layer is formed in the light emitting region provided in the top plate of the induction heating appliance for cooking.

Further, the construction shown in FIG. 13D is such that a center area of the light emitting region 35*b* is rendered to be a transparent area 78 having no light diffusing layer formed therein; a first peripheral area is provided in a stripe shape at a location radially outwardly of the center area and is formed by a semitransparent annular light diffusing layer 76; and a second peripheral area is provided in a stripe shape at a location radially outwardly of the first peripheral area and is formed by a colored light transmittable layer 80 having a light transmittance lower than that of the first peripheral area.

Figure 13E:
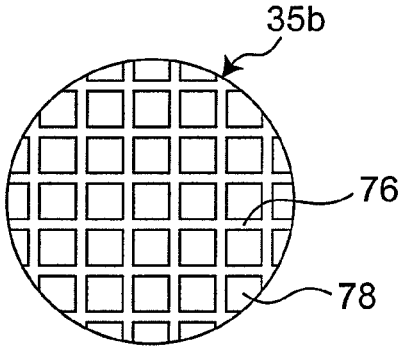
FIG. 13E is a front elevational view in the case where a yet further light diffusing layer is formed in the light emitting region provided in the top plate of the induction heating appliance for cooking.

Yet, the construction shown in FIG. 13E is such that a semitransparent light diffusing layer 76 is formed in a grid pattern in the transparent area 78 provided in the light emitting region 35*b*.

It is to be noted that although in any one of the constructions shown respectively in FIGS. 13B to 13E, the transparent area 78 is provided in a part of the light emitting region 35*b*, a different light diffusing layer having a light transmittance higher than that of the light diffusing layer 76 may be provided in place of this transparent area 78.

INDUSTRIAL APPLICABILITY

Since the induction heating appliance for cooking according to the present invention is so designed that the region of incidence of the infrared rays of light emanating from the article to be heated such as, for example, a pot upon the infrared sensor can be easily noticed with eyes, all that is performed by the user is to place the article to be heated on the top plate so as to cover the infrared incident region and, hence, the induction heating appliance for cooking according to the present invention is useful as an induction heating appliance for home cooking that can be built in a household kitchen.

The invention claimed is:

1. An induction heating appliance for cooking which comprises:

a body;

a light transmittable top plate provided atop the body and having a heating area for heating an article to be heated with the latter placed thereon;

a heating coil disposed below the top plate in face-to-face relation with the heating area for generating magnetic fields necessary to induction heat the article to be heated, the heating coil having an inner coil and an outer coil surrounding the inner coil;

an infrared sensor disposed below the top plate for detecting infrared rays of light from the article to be heated;

a light emitting element emitting visible light, which is disposed below the top plate;

a light guide portion which is defined by only one light guide tube, the light guide tube having only one longitudinal axis, the light guide portion being configured such that the infrared rays of light from the article to be heated are guided to the infrared sensor along the only one longitudinal axis of the light guide tube, and such that the visible light from the light emitting element is guided to the top plate along the only one longitudinal axis of the light guide tube; and a controller connected between the heating coil and the infrared sensor for controlling an output of the heating coil based on an output signal from the infrared sensor, wherein the light guide portion is positioned between the inner coil and the outer coil so as to be offset from a center of the heating coil, and wherein the top plate is provided with an infrared incident region positioned immediately above an upper opening of the light guide portion to guide the infrared rays of light, emitted from the article to be heated, towards the light guide portion, and the infrared incident region is positioned only at one location inwardly of an outer periphery of the heating coil and on a straight line extending in a forward and rearward direction of the body and passing across the center of the heating coil or its proximity when viewed from above the body, the only one location of the infrared incident region being offset forwardly from the center of the heating coil at a corresponding position of the light guide portion so that rays of light emanating from the light emitting element are emitted within or in proximity to the infrared incident region to allow the rays of light to be noticed within the heating area when viewed from above the body in a condition that the infrared incident region is not covered by the article to be heated.

2. The induction heating appliance for cooking as claimed in claim 1, wherein the infrared incident region is positioned such that the light emitted from the light emitting element is caused to illuminate in proximity to the infrared incident region and such light is noticeable within the heating area when viewed from above the body in the condition that the infrared incident region is not covered by the article to be heated.

3. An induction heating appliance for cooking which comprises:

a body;

a light transmittable top plate provided atop the body and having a heating area for heating an article to be heated with the latter placed thereon;

a heating coil disposed below the top plate in face-to-face relation with the heating area for generating magnetic fields necessary to induction heat the article to be heated;

an infrared sensor disposed below the top plate for detecting infrared rays of light from the article to be heated;

a light emitting element emitting visible light, which is disposed below the top plate;

a light guide portion which is defined by only one light guide tube, the light guide tube having only one longitudinal axis, the light guide portion being configured such that the infrared rays of light from the article to be heated are guided to the infrared sensor along the only one longitudinal axis of the light guide tube, and such that the visible light from the light emitting element is guided to the top plate along the only one longitudinal axis of the light guide tube; and a controller connected between the heating coil and infrared sensor for controlling an output of the heating coil based on an output signal from the infrared sensor, wherein the light guide portion is offset from a center of the heating coil, and wherein the top plate is provided with an infrared incident region positioned only at one location inwardly of an outer periphery of the heating coil and offset from the center of the heating coil at a corresponding position of the light guide portion to guide the infrared rays of light, emitted from the article to be heated, towards the light guide portion, so that rays of light emanating from the light emitting element are emitted within the infrared incident region to allow the rays of light to be noticed within the heating area when viewed from above the body in a condition that the infrared incident region is not covered by the article to be heated, and wherein the light guide portion guides the light, emitted from the light emitting element, towards the infrared incident region, and the infrared incident region is partly or entirely noticeable when the light emitted from the light emitting element and guided within the light guide portion is projected towards the top plate through an opening of the light guide portion.

4. The induction heating appliance for cooking as claimed in claim 1, wherein when viewed from above the body, the infrared incident region has a center arranged on a straight line passing across the center of the heating coil and a center of a light emitting portion, which is a region where the light emitted from the light emitting element can be noticed, or its vicinity and between the center of the heating coil and the center of the light emitting portion.

5. The induction heating appliance for cooking as claimed in claim 4, wherein there is further provided a light guide element, upon which the light from the light emitting element is incident and which has a light emitting surface illuminated in an annular shape, and the light from the light emitting element is guided from the light emitting surface of the light emitting element towards the light guide portion.

6. The induction heating appliance for cooking as claimed in claim 5, wherein the infrared rays of light radiated from the article to be heated are guided towards the infrared sensor through the upper opening of the light guide portion and a through-hole formed inside the light emitting surface.

7. The induction heating appliance for cooking as claimed in claim 4, wherein the infrared sensor and the light emitting element altogether form a sensor unit, and the sensor unit includes:

a printed circuit board for fixing and electrically connecting the infrared sensor and the light emitting element; and a housing made of an electroconductive metallic material and accommodating therein the printed circuit board, wherein the housing has a lower extension tube extending towards the infrared sensor and the light emitting element, with the infrared sensor and the light emitting element being accommodated within the lower extension tube.

8. The induction heating appliance for cooking as claimed in claim 7, further comprising a light diffusing ring having a through-hole above the infrared sensor and the light emitting element, wherein the infrared sensor is arranged below the through-hole.

9. An induction heating appliance for cooking which comprises:

a body;

a light transmittable top plate provided atop the body and having a heating area for heating an article to be heated with the latter placed thereon;

a heating coil disposed below the top plate in face-to-face relation with the heating area for generating magnetic fields necessary to induction heat the article to be heated;

an infrared sensor disposed below the top plate for detecting infrared rays of light from the article to be heated;

a light emitting element emitting visible light, which is disposed below the top plate;

a first light guide portion which is defined by only one first light guide tube, the first light guide tube having only one longitudinal axis, the first light guide portion being configured such that the infrared rays of light from the article to be heated are guided to the infrared sensor along the only one longitudinal axis of the first light guide tube;

a second light guide portion which is defined by only one second light guide tube, the second light guide tube having only one longitudinal axis, the second light guide portion being configured such that the visible light from the light emitting element is guided to the top plate along the only one longitudinal axis of the second light guide tube, the second light guide portion being separated from the first light guide portion by a light shielding wall, and the longitudinal axis of the first light guide tube and the longitudinal axis of the second light guide tube being parallel to each other; and a controller connected between the heating coil and infrared sensor for controlling an output of the heating coil based on an output signal from the infrared sensor, wherein the first and second light guide portions are offset from a center of the heating coil, wherein the top plate is provided with an infrared incident region positioned immediately above an upper opening of the first light guide portion only at one location inwardly of an outer periphery of the heating coil and offset from the center of the heating coil to guide the infrared rays of light, emitted from the article to be heated, towards the first light guide portion, so that rays of light emanating from the light emitting element are emitted in proximity to the infrared incident region to allow the rays of light to be noticed within the heating area when viewed from above the body in a condition that the infrared incident region is not covered by the article to be heated, and wherein a light diffusing layer is arranged in proximity to the infrared incident region and immediately above an upper opening of the second light guide portion so that the light emitted from the light emitting element travels through the second light guide portion to illuminate the light diffusing layer.

10. An induction heating appliance for cooking which comprises:

a body;

a light transmittable top plate provided atop the body and having a heating area for heating an article to be heated with the latter placed thereon;

a heating coil disposed below the top plate in face-to-face relation with the heating area for generating magnetic fields necessary to induction heat the article to be heated;

an infrared sensor disposed below the top plate for detecting infrared rays of light from the article to be heated;

a light emitting element emitting visible light, which is disposed below the top plate;

a light guide portion which is defined by only one light guide tube, the light guide tube having only one longitudinal axis, the light guide portion being configured such that the infrared rays of light from the article to be heated are guided to the infrared sensor along the only one longitudinal axis of the light guide tube, and such that the visible light from the light emitting element is guided to the top plate along the only one longitudinal axis of the light guide tube; and a controller connected between the heating coil and infrared sensor for controlling an output of the heating coil based on an output signal from the infrared sensor, wherein the light guide portion is offset from a center of the heating coil, wherein the top plate is provided with an infrared incident region positioned immediately above an upper opening of the light guide portion only at one location inwardly of an outer periphery of the heating coil and offset from the center of the heating coil to guide the infrared rays of light, emitted from the article to be heated, towards the light guide portion, so that rays of light emanating from the light emitting element are emitted within or in proximity to the infrared incident region to allow the rays of light to be noticed within the heating area when viewed from above the body in a condition that the infrared incident region is not covered by the article to be heated, and wherein the infrared incident region is arranged, when viewed from above the body, on a straight line passing across the center of the heating coil and a center of the light emitting region or its vicinity, the light emitting region being a region at which the rays of light emitted from the light emitting element are noticeable, and between the center of the heating coil and the center of the light emitting region.

11. The induction heating appliance for cooking as claimed in claim 2, wherein when viewed from above the body, the infrared incident region has a center arranged on a straight line passing across the center of the heating coil and a center of a light emitting region, which is a region where the light emitted from the light emitting element can be noticed, or its vicinity and between the center of the heating coil and the center of the light emitting region.

12. The induction heating appliance for cooking as claimed in claim 1, wherein the infrared incident region is positioned such that the rays of light emanating from the light emitting element are emitted within the infrared incident region through the light guide portion to allow the rays of light to be noticed within the heating area when viewed from above the body in the condition that the infrared incident region is not covered by the article to be heated.

* * * * *